US011094299B2

(12) United States Patent
Colas et al.

(10) Patent No.: US 11,094,299 B2
(45) Date of Patent: Aug. 17, 2021

(54) LOCKING BRIDGE ASSEMBLY

(71) Applicant: ADVANCED PLATING, INC., Nashville, TN (US)

(72) Inventors: Jeremy Colas, Murfreesboro, TN (US); Steve Tracy, Gallatin, TN (US)

(73) Assignee: ADVANCED PLATING, INC., Nashville, TN (US)

( * ) Notice: Subject to any disclaimer, the term of this patent is extended or adjusted under 35 U.S.C. 154(b) by 0 days.

(21) Appl. No.: 16/557,545

(22) Filed: Aug. 30, 2019

(65) Prior Publication Data

US 2019/0385575 A1 Dec. 19, 2019

Related U.S. Application Data

(63) Continuation of application No. 15/412,640, filed on Jan. 23, 2017, now Pat. No. 10,446,122.

(60) Provisional application No. 62/367,956, filed on Jul. 28, 2016.

(51) Int. Cl.
*G10D 3/12* (2020.01)
*G10D 3/04* (2020.01)

(52) U.S. Cl.
CPC ..... *G10D 3/12* (2013.01); *G10D 3/04* (2013.01)

(58) Field of Classification Search
CPC .. G10D 3/12; G10D 3/04; G10D 3/00; G10D 3/13
See application file for complete search history.

(56) References Cited

U.S. PATENT DOCUMENTS

| | | | | |
|---|---|---|---|---|
| 3,437,001 | A | 4/1969 | Kraft | |
| 5,285,710 | A | 2/1994 | Chapman | |
| 5,739,444 | A | 4/1998 | Borisoff | |
| 6,613,968 | B1 | 9/2003 | Devereaux et al. | |
| 6,686,523 | B1 | 2/2004 | Devereaux et al. | |
| 2005/0160897 | A1* | 7/2005 | Hirayama | G10D 3/153 84/307 |
| 2006/0162528 | A1 | 7/2006 | Kinoshita | |
| 2009/0314152 | A1 | 12/2009 | Shamblin | |
| 2010/0005944 | A1 | 1/2010 | Eliasson | |
| 2013/0055876 | A1 | 3/2013 | Mason | |
| 2015/0047493 | A1* | 2/2015 | Leadbetter | G10G 7/02 84/454 |

FOREIGN PATENT DOCUMENTS

| | | |
|---|---|---|
| DE | 020309710 | 10/2003 |

* cited by examiner

*Primary Examiner* — Kimberly R Lockett
(74) *Attorney, Agent, or Firm* — Greenblum & Bernstein, P.L.C.

(57) ABSTRACT

A bridge body for a bridge assembly for a stringed instrument. The bridge body includes a plurality of saddle regions arranged in the bridge body, each of the saddle regions configured to accommodate a saddle, two receiving passages that pass through the bridge body from an upper side of the bridge body to a lower side of the bridge body, and upper recessed contact surfaces respectively arranged at upper ends of the receiving passages.

22 Claims, 17 Drawing Sheets

FIG. 12A
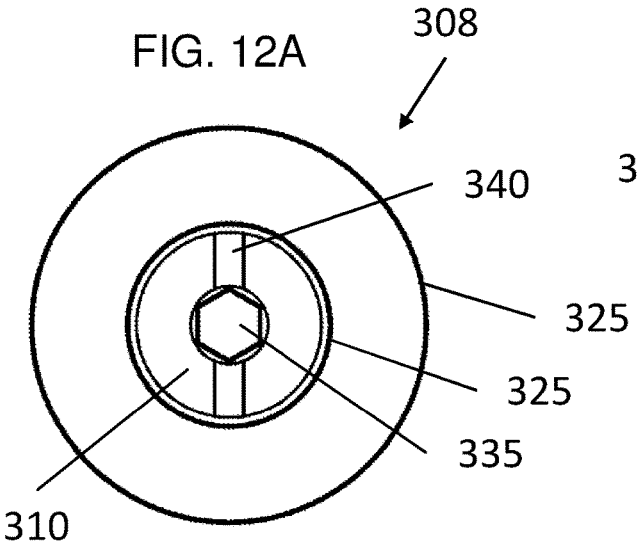
FIG. 12C
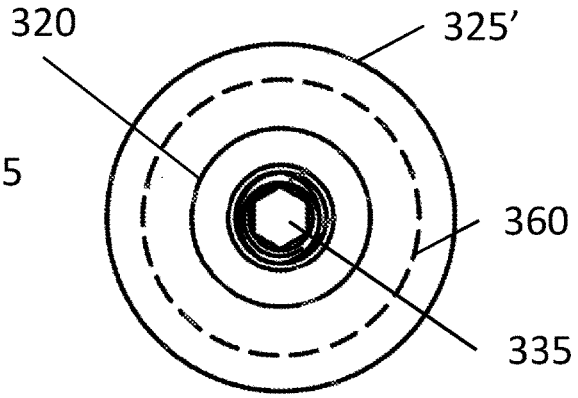
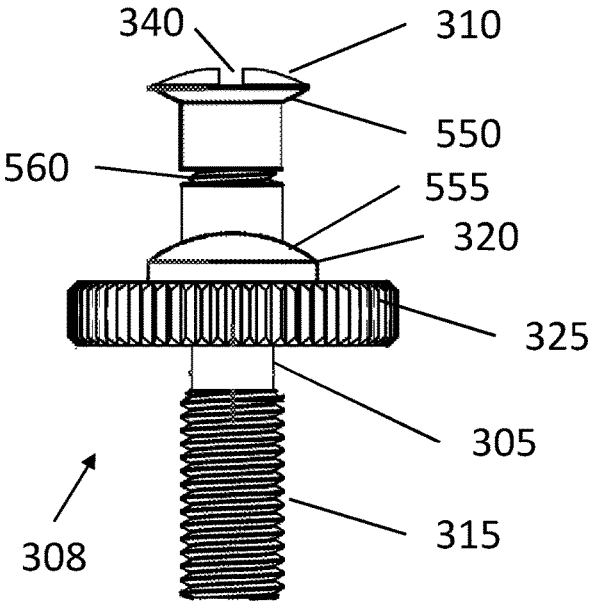
FIG. 12B
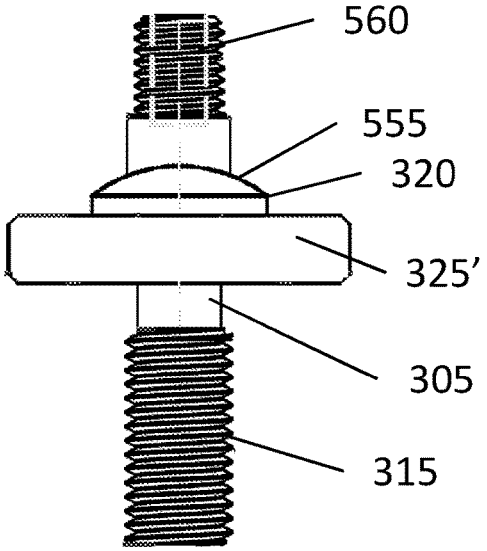
FIG. 12D

FIG. 13A
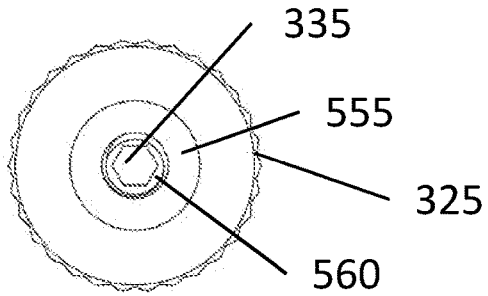
FIG. 13B
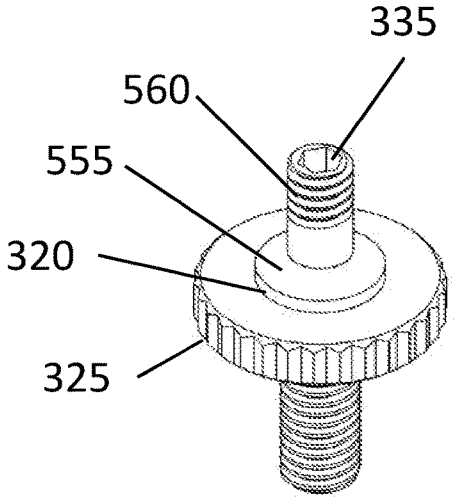
FIG. 13D
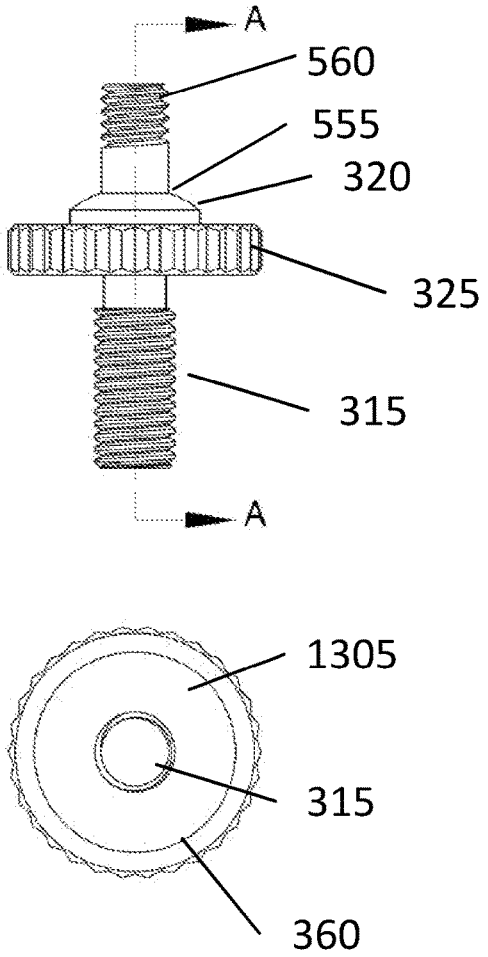
FIG. 13C
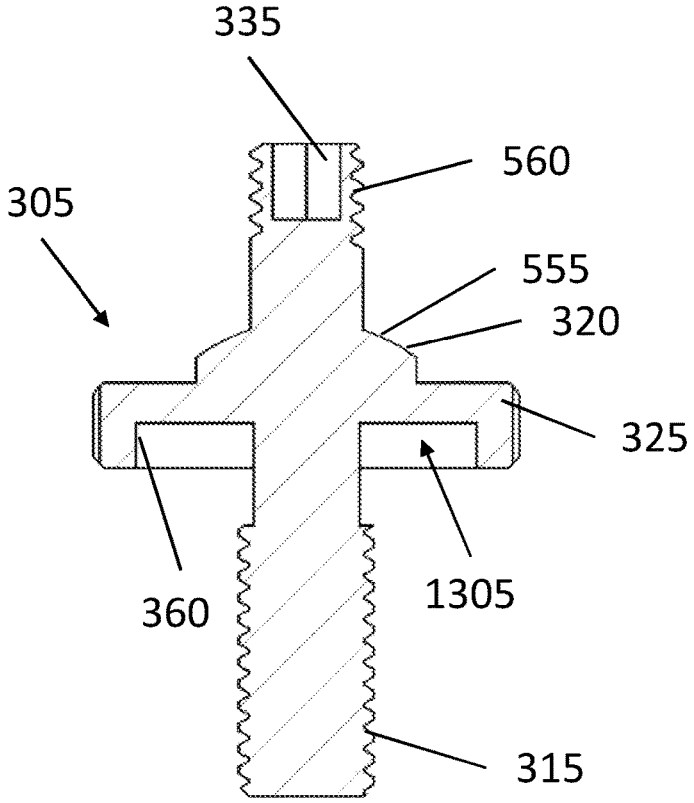
Section A-A
FIG. 13E Section B-B

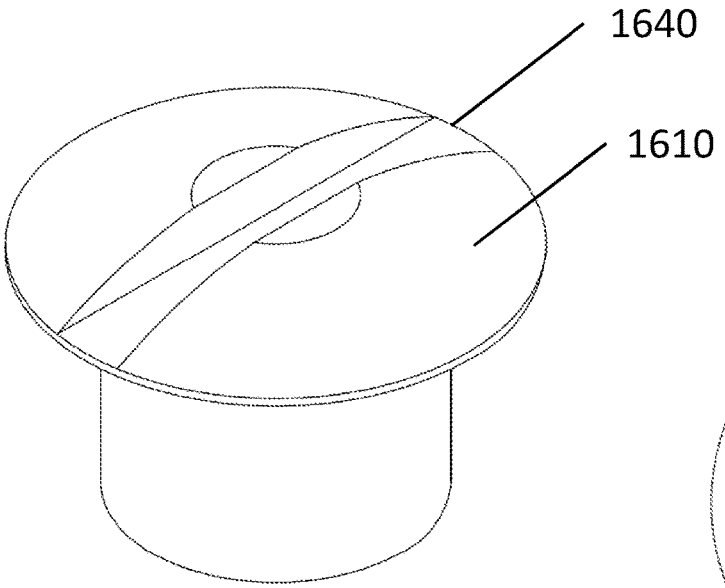
FIG. 16A
FIG. 16C
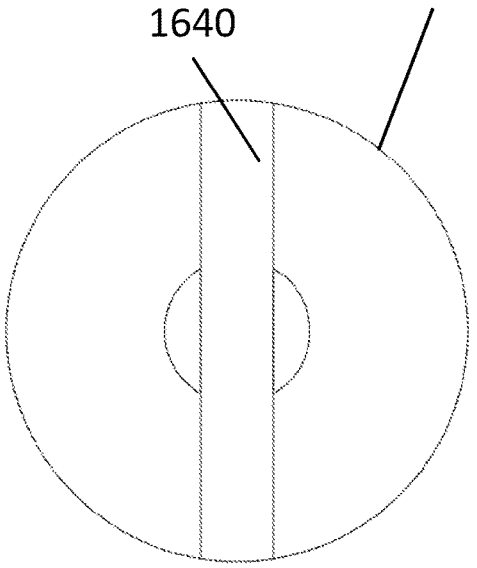
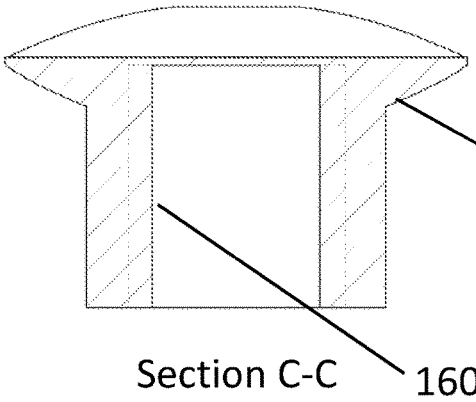
FIG. 16B
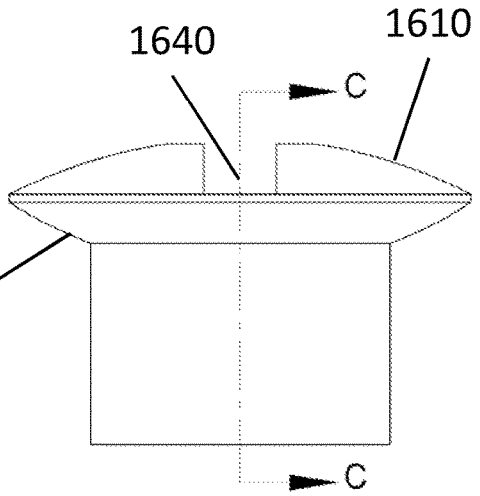
FIG. 16D

FIG. 17A
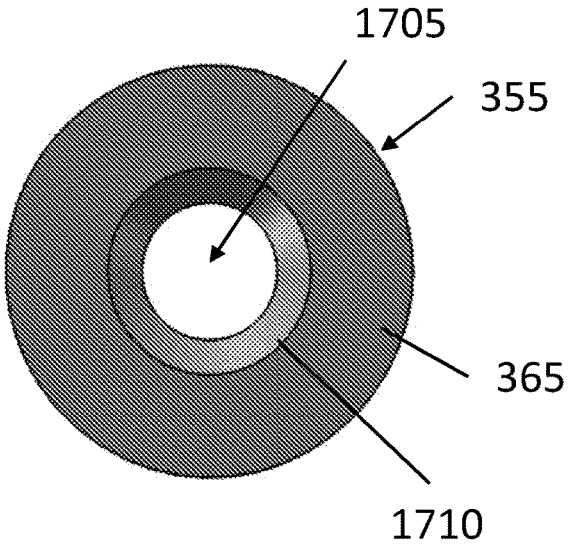
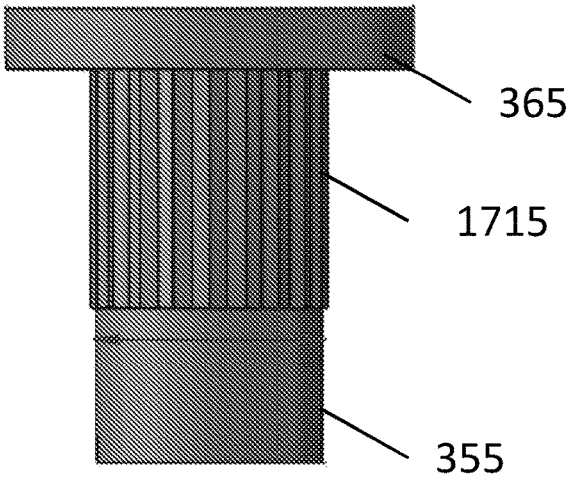
FIG. 17B
FIG. 17C
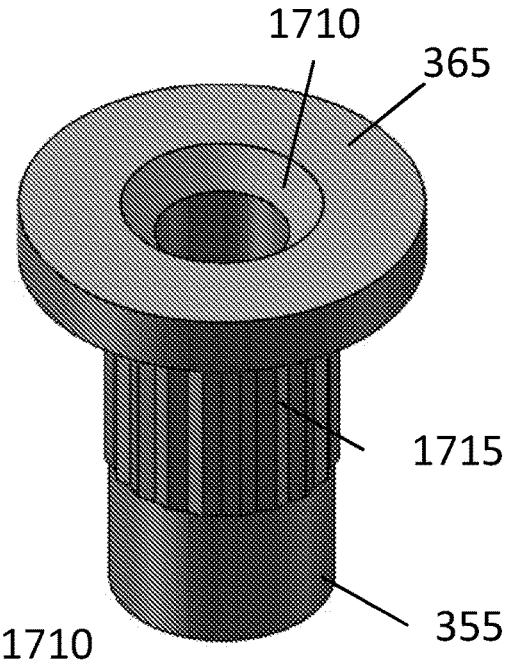
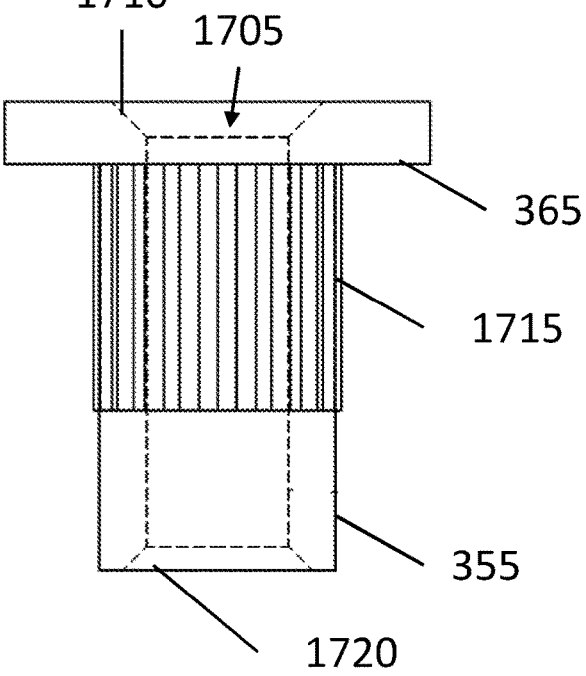
FIG. 17D

LOCKING BRIDGE ASSEMBLY

CROSS REFERENCE TO RELATED APPLICATION

The present application is a continuation of U.S. application Ser. No. 15/412,640, filed Jan. 23, 2017, which claims the benefit of U.S. Provisional Application No. 62/367,956, filed Jul. 28, 2016, the contents of both applications are expressly incorporated herein by reference in their entireties.

BACKGROUND OF THE DISCLOSURE

1. Field of the Disclosure

This disclosure relates to stringed instruments, and more particularly to a locking bridge apparatus for a stringed instrument (e.g., guitar).

2. Description of the Related Art

A bridge is a device that supports the strings on a stringed musical instrument and transmits the vibration of those strings to some other structural component of the instrument. A tailpiece is a component on many stringed musical instruments that anchors one end of the strings that pass over a bridge, usually opposite the end with the tuning mechanism (e.g., on the headstock). The tailpiece anchors the strings, so the tailpiece should be strong enough to withstand the combined tension of the strings. The bridge and tailpiece, while serving separate purposes, work closely together to affect playing style and tone.

The Tune-o-matic (or TOM) bridge includes two adjustable posts that are screwed into the guitar body and a bar between these posts. The bar has six saddles, one per string. Each saddle has a groove where the string is held by the saddle. When fully assembled, each string sits astride a saddle, and the saddle thus "marks" the end of the vibrating string. Each saddle can be adjusted (moved back and forward) with a screw to control intonation. To prevent saddles from falling out of the bridge when no strings are installed, most models hold the saddles with a retainer wire or wires.

Some guitars have a stopbar to hold strings, others have "strings through the body" construction, which uses the body of the guitar to hold the end of the strings. After passing over the saddles, each string goes to the tailpiece (or through the instrument body). Since the introduction of the Tune-o-matic (TOM) bridge, different versions of the bridge have emerged, with some different parameters and properties (e.g., sizes, materials) between them. Two such styles are the ABR-1 bridge and the Modern TOM, or "Nashville" bridge.

Thus, a guitar bridge (e.g., a TOM bridge) is conventionally mounted to the instrument (e.g., guitar) using two bridge posts, which mount into respective grommets arranged on the instrument body. The bridge posts each have a planar support platform configured to support respective lower planar surfaces of respective ends of the bridge.

Each bridge post is height-adjustable via threaded engagement with the respective grommets, to adjust the heights of the respective support platforms on the bridge posts, so that a user may, for example, adjust the height of the bridge. For example, due to the bridge post's threaded engagement with the guitar body (or with a grommet on the body of the guitar), rotating the bridge post brings about a change in the platform height of the bridge post. The bridge is height-adjustable, for example to allow a user to modify the string heights (which are supported, for example between respective saddles in the bridge on one end and a nut at the other end) over the fret board.

U.S. Pat. No. 6,613,968 teaches a conventional bridge mounting system. As explained in this document, the bridge mounting system comprises two bridge posts, each have a planar support platform configured to support respective lower planar surfaces of respective ends of the bridge, lower threaded portion configured for threaded engagement in respective grommets on the body of the guitar, and upper mounting ends above the planar support platform. The bridge includes two cylindrical mounting holes (or receiving passages) on respective ends of the bridge configured to receive the upper mounting ends of the bridge posts, such that the bridge is supported on the planar support platforms of the bridge post.

As noted above, the bridge post is removably mounted into the instrument body by fastening the lower threaded portion into a threaded hole or grommet on the body of the guitar. Thus, the heights of the bridge posts and, consequently, the bridge arranged on the planar support platforms of the bridge posts may be adjusted by rotating the bridge posts up or down via the plate relative to the instrument body.

With conventional bridges, in order to maintain the desired maximum contact between the planar support platforms and the lower planar surfaces of the bridge, each of the bridge post heights must be set uniformly (i.e., of equal height to each other) so that the bridge retains a parallel orientation (i.e., relative to the upper surface of the guitar body). That is, only when the bridge is horizontally arranged (i.e., relative to the upper surface of the guitar body) do the surfaces of the planar support platforms and the lower planar surfaces of the bridge align to permit an areal engagement between the bridge and the bridge posts. In such a manner, the conventional bridge is unable to be adjusted to meet the wide variety of preferences of players.

Put another way, when a conventional bridge is mounted in an unparallel manner, the contact between the bridge and the bridge posts is reduced from areal contact to linear contact, which reduces the bridge assembly's ability to transfer the energy of the vibrating strings to and through the instrument. Thus, with current bridge assemblies, if a non-parallel bridge body orientation is desired, the bridge assembly is not operable to provide optimal contact between the bridge assembly components.

Therefore, there is a need for an improved bridge assembly that solves these above-noted deficiencies, provides improved performance and improved usability.

SUMMARY OF THE EMBODIMENTS OF THE DISCLOSURE

Aspects of the present disclosure are directed to a bridge assembly, comprising a bridge body having lower concave contact surfaces, and two bridge post assemblies each comprising a bridge post having a support platform operable to support respective ends of the bridge body. Each support platform comprises a convex contact surface configured for respective engagement with the lower concave contact surfaces of the bridge body.

In embodiments, each bridge post assembly further comprises a cap structured and arranged for threaded engagement with an upper end of the bridge post so as to lock the bridge body to the bridge posts.

In further embodiments, the bridge body further comprises upper concave contact surfaces, wherein each cap comprises a lower convex contact surface configured for respective engagement with the upper concave contact surfaces.

In embodiments, the convex contact surface of the support platform and the convex contact surface of the cap are operable to pinch respective ends of the bridge body so as to retain the bridge body on the bridge posts.

In embodiments, the bridge body further comprises two receiving passages that pass through the bridge body, and wherein the lower concave contact surfaces of the bridge body are arranged at the lower end of the receiving passages.

In embodiments, the bridge body further comprises two receiving passages that pass through the bridge body, and are each operable to receive a portion of the bridge post and a portion of the cap.

In further embodiments, the bridge body further comprises two receiving passages that pass through the bridge body, and wherein the lower concave contact surfaces of the bridge body are arranged at the lower ends of the receiving passages, and the upper concave contact surface of the bridge body are arranged at the upper ends of the receiving passages.

In some embodiments, the receiving passages are tapered and have a smaller upper opening to the upper concave contact surfaces and a larger bottom opening to the lower concave contact surfaces.

In yet further embodiments, the convex contact surface of the support platform and the convex contact surface of the cap are operable to provide areal contact between both the bridge body and the support platform, and the bridge body and the cap when the bridge body is arranged in a non-parallel or tilted manner.

In embodiments, the bridge post comprises an upper externally-threaded portion and a socket, and the cap includes an internally-threaded portion configured for engagement with the upper externally-threaded portion.

In further embodiments, the cap additionally includes a through-hole structured and arranged to provide access through the cap to the socket when the cap is attached to the bridge post.

In embodiments, the bridge post further comprises a lower threaded portion configured for threaded engagement with a stringed instrument.

In yet further embodiments, a longitudinal axis of the receiving passage is along a longitudinal axis of the bridge post.

In embodiments, the bridge body is a Nashville style bridge body.

In further embodiments, the bridge body is an ABR-1 style bridge body.

In embodiments, the cap further comprises a slot structured and arranged for receiving a slotted adjustment tool.

In yet further embodiments, the bridge assembly further comprises two grommets structured and arranged for connection to an instrument body, and configured for threaded-engagement with lower ends of the two bridge post assemblies, respectively.

Further aspects of the present disclosure are directed to a bridge assembly for a stringed instrument, comprising a bridge body having lower concave contact surfaces and upper concave contact surfaces, and two receiving passages that pass through the bridge body, wherein the lower concave contact surfaces are arranged at the lower ends of the respective receiving passages, and the upper concave contact surfaces are arranged at the upper ends of the respective receiving passages, and two bridge post assemblies each comprising a bridge post having a support platform operable to support respective ends of the bridge body, and a cap structured and arranged for threaded engagement with an upper end of the bridge post. The support platform comprises a convex contact surface configured for engagement with the lower concave contact surface of the bridge body. The cap comprises a lower convex contact surface configured for engagement with the upper concave contact surface of the bridge body. The two receiving passages are each operable to receive a portion of the bridge post and a portion of the cap. The convex contact surface of the support platform and the convex contact surface of the cap are operable to pinch respective ends of the bridge body so as to retain the bridge body on the bridge posts. The convex contact surface of the support platform and the convex contact surface of the cap are operable to provide areal contact between both the bridge body and the support platform and the bridge body and the cap when the bridge body is arranged in a non-parallel or tilted manner.

Additional aspects of the present disclosure are directed to a bridge body for a bridge assembly of a stringed instrument, the bridge body comprising two receiving passages that pass through the bridge body, lower concave contact surfaces arranged at the lower end of the receiving passages, and upper concave contact surfaces arranged at the upper ends of the receiving passages.

Further aspects of the present disclosure are directed to a bridge post assembly for a stringed instrument, the bridge post assembly comprising a bridge post having a support platform comprising a convex contact surface configured for engagement with an lower concave contact surface of a bridge body, and a cap structured and arranged for threaded engagement with an upper end of the bridge post, wherein the cap comprises a lower convex contact surface configured for engagement with an upper concave contact surface of the bridge body.

BRIEF DESCRIPTION OF THE DRAWINGS

The novel features which are characteristic of the systems, both as to structure and method of operation thereof, together with further aims and advantages thereof, will be understood from the following description, considered in connection with the accompanying drawings, in which embodiments of the system are illustrated by way of example. It is to be expressly understood, however, that the drawings are for the purpose of illustration and description only, and they are not intended as a definition of the limits of the system. For a more complete understanding of the disclosure, as well as other aims and further features thereof, reference may be had to the following detailed description of the embodiments of the disclosure in conjunction with the following exemplary and non-limiting drawings wherein:

FIGS. 12A-12D show various views of a bridge post and upper cap of a bridge assembly in accordance with aspects of the present disclosure;

FIGS. 13A-13E show various views of a bridge post in accordance with aspects of the present disclosure;

FIGS. 16A-16D show various views of another upper cap of a bridge assembly in accordance with aspects of the present disclosure; and FIGS. 17A-17D show various views of a grommet of a bridge assembly in accordance with aspects of the present disclosure.

Figure 1:
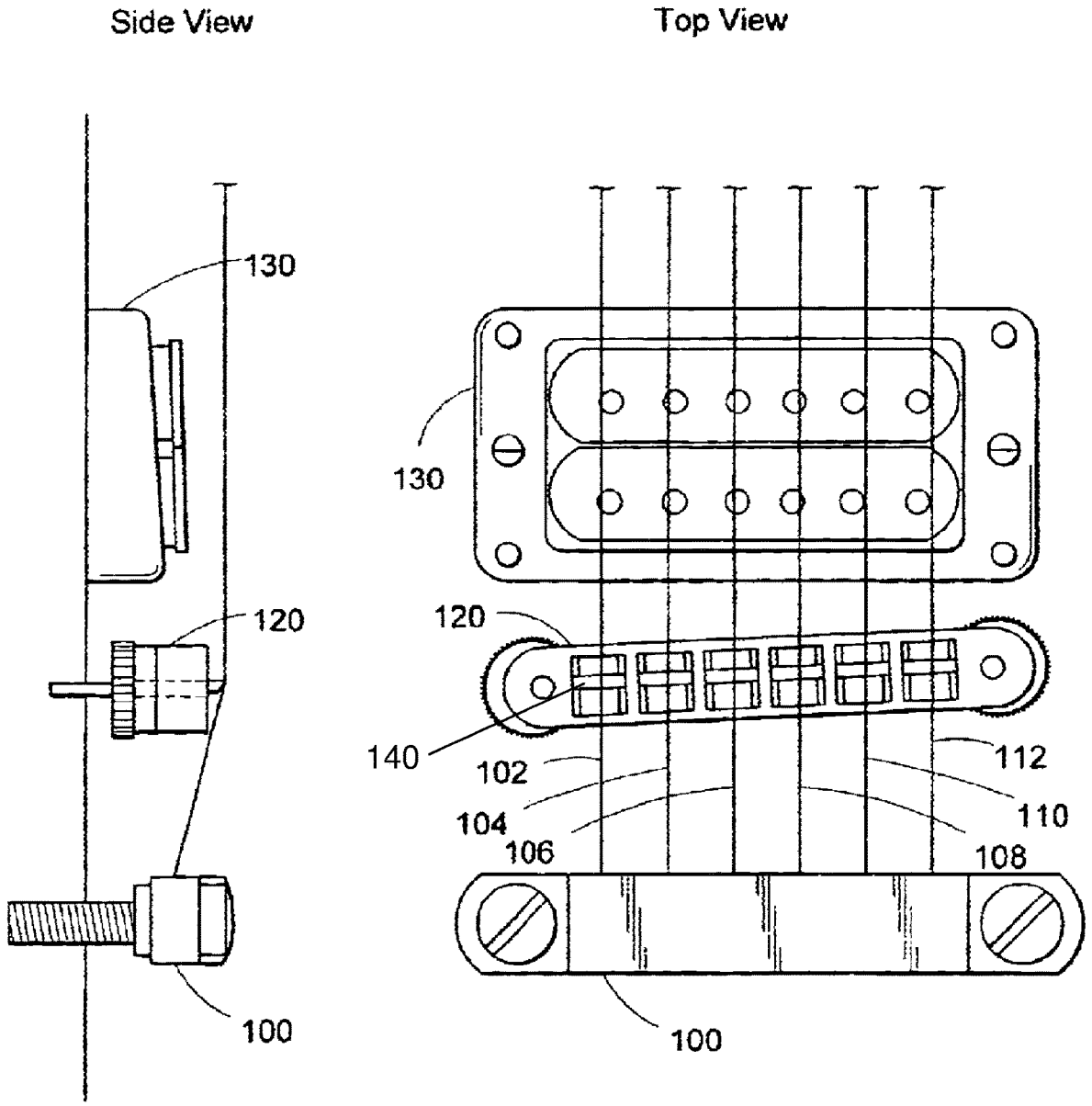
FIG. 1 (Prior Art)
FIG. 1 is a top and side view of a conventional guitar upon which a guitar bridge is mounted.

Reference numbers refer to the same or equivalent parts of the present disclosure throughout the various figures of the drawings.

DETAILED DESCRIPTION OF THE EMBODIMENTS OF THE DISCLOSURE

In the following description, the various embodiments of the present disclosure will be described with respect to the enclosed drawings. As required, detailed embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the indefinite article "a" indicates one as well as more than one and does not necessarily limit its referent noun to the singular.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of", so that for instance "a composition comprising a compound A" may also (essentially) consist of the compound A.

The various embodiments disclosed herein can be used separately and in various combinations unless specifically stated to the contrary.

FIG. 1 is a top and side view of a conventional guitar upon which a guitar bridge and tailpiece is mounted. As shown in FIG. 1, with this exemplary embodiment, a tailpiece 100 is mounted on a body of an exemplary 6-string guitar and holds one end of strings 102, 104, 106, 108, 110, and 112. With this arrangement, the tailpiece 100 provides the mechanical strength for the tension of the stretched strings against the body of the guitar. These strings 102, 104, 106, 108, 110, and 112 then pass over a bridge 120, which is used to initially set the tuning of the guitar so the guitar plays in tune with the proper tone and timbre. The bridge 120 includes a number of saddles (e.g., one or two for each string), wherein each string passes (or two strings pass) over a respective saddle. Each saddle may be similarly constructed and may include one or more notches, through which the string passes to hold its respective string above the bridge and guitar at a desired height. Alternatively, in embodiments, the saddles may have no notches at all. The position of each saddle (within the bridge) along the length of the guitar (i.e., in a string extension direction) may be altered to adjust the intonation of each string.

As shown in FIG. 1, in an electric guitar, the strings 102, 104, 106, 108, 110, and 112 also pass over one or more magnetic or other types of pickups 130. The pickups 130 are used to convert the physical vibrations of the strings 102, 104, 106, 108, 110, and 112 into electrical signals that can then be electrically amplified.

The strings 102, 104, 106, 108, 110, and 112 then extend over, but do not contact, multiple frets (not shown) on the guitar. Towards a neck of the guitar, the strings 102, 104, 106, 108, 110, and 112 then pass over a nut (not shown) to tuning pegs (not shown). The tuning pegs are adjustable to increase or decrease the tension of each respective string 102, 104, 106, 108, 110, and 112, which raises or lowers the frequency of the tone of each string so that the proper notes are heard upon plucking or strumming the guitar. Between the nut and the bridge 120 are the various frets between which the strings 102, 104, 106, 108, 110, and 112 are depressed so that the effective length of the string is shortened to thereby increase the frequency at which that particular string vibrates.

An important factor in a quality electric guitar is the guitar sound. The material of the body, the quality of the magnetic or other pickups (e.g., piezo pickups), the rigidity of the guitar itself, the accuracy of the placement and spacing of the strings 102, 104, 106, 108, 110, and 112 above the fingerboard and associated frets, the actual placement of the frets, and the quality of the tuning bridge 120 and tailpiece 100 are all important to the overall sound of the guitar.

The strings 102, 104, 106, 108, 110, and 112 are stretched initially between the bridge 120 and the nut (not shown) just to tune the strings 102, 104, 106, 108, 110, and 112 to their proper respective note. Then the strings 102, 104, 106, 108, 110, and 112 are stressed further by a guitar player, upon playing, by forcing the strings 102, 104, 106, 108, 110, and 112 down onto the fingerboard between frets.

Figure 2:
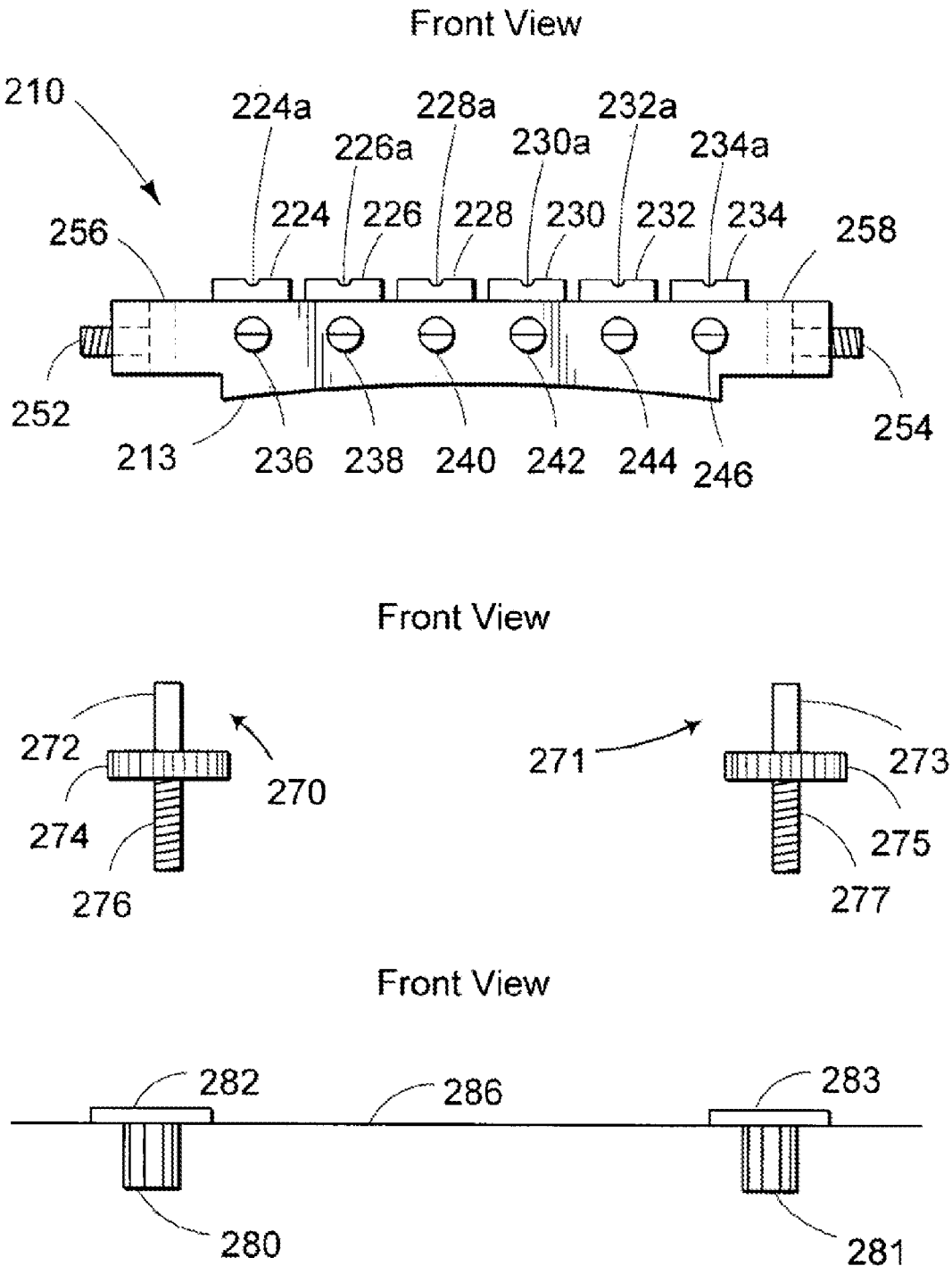
FIG. 2 (Prior Art)
FIG. 2 depicts front views of components of a conventional guitar bridge assembly.

FIG. 2 depicts front views of components of a conventional guitar bridge assembly. As shown in FIG. 2, the guitar bridge 210 comprises a long and narrow base piece that is formed of standard metal, such as steel or brass. Vertically through each end of the bridge 210 are vertical alignment holes 256 and 258 extending from the top surface 211 to the bottom surface 213. Adjustment posts 270 and 271 are generally rounded longitudinal elements which are threaded on a bottom section 276 and 277 and smooth along an upper section 272 and 273. These adjustment posts 270 and 271 may be fixedly mounted on the guitar body at the factory or at the store from which the guitar 286 is purchased. Circular adjustment wheels 274 and 275 are made with threaded holes through the center of each wheel 274 and 275. These threaded holes are mated with the adjustment posts 270 and 271. Alternatively, the adjustment wheel 274 and 275 may be constructed in one piece with the adjustment posts 270 and 271.

When the guitar 286 is assembled, the adjustment posts 270 and 271 are placed into holes drilled or otherwise formed in the body of the guitar 286. A glue or other adhesive is placed in the drilled holes and on the bottom sections 276 and 277 of the adjustment posts 270 and 271 which permanently mounts the posts 270 and 271 to the guitar body. Alternatively, the adjustment posts 270 and 271 may be pounded into the holes with a mallet or similar device to form a tight friction bond. Additionally, the adjustment posts 270 and 271 may be screwed into holes 282 and 283 in grommets 280 and 281 which are permanently mounted in the body of the guitar 286. Using grommets 280 and 281 allows the adjustment posts 271 and 272 to be easily replaced, although this is rarely necessary. The adjustment posts 270 and 271 are then rotated up or down along the threaded bottom sections 276 and 277 to adjust the height of the bridge 210 above the guitar body.

After the adjustment posts 271 and 272 are mounted in the guitar body, the guitar bridge 210 is placed over the adjustment posts 270 and 271 and rests on upper surfaces of each adjustment wheel 274 and 275. With this conventional system, the posts 270 and 271 and alignment holes 256 and 258 in the bridge 210 are manufactured with close tolerances, but the bridge 210 is not yet fixedly mounted to the posts 271 and 272.

As shown in FIG. 2, with the conventional bridge mounting system, the two bridge posts each have a planar support platform configured to support respective lower planar surfaces of respective ends of the bridge. The bridge includes two cylindrical mounting holes (or receiving passages) on respective ends of the bridge configured to receive the upper mounting ends of the bridge posts, such that the lower planar surface of the bridge is supported on the planar support platforms of the bridge post.

With conventional bridges, in order to maintain the desired or optimal contact between the planar support platforms and the lower planar surfaces of the bridge, each of the bridge post heights must be set uniformly (i.e., of equal height) so that the bridge retains a parallel orientation (i.e., relative to the upper surface of the guitar body). That is, only when the bridge is horizontally arranged (i.e., relative to the general planar upper surface of the guitar body) do the surfaces of the planar support platforms and the lower planar surfaces of the bridge align to permit an areal engagement between the bridge and the bridge posts. In such a manner, the conventional guitar bridge assembly is unable to be adjusted to meet the preference of the player. Conversely, when a conventional bridge is mounted in an unparallel manner (e.g., to meet the preference of the player), the contact between the bridge and the bridge posts is reduced from areal contact to linear contact, which reduces the bridge assembly's ability to transfer the energy of the vibrating strings to and through the instrument.

The present disclosure also provides for improving the sound from the guitar by creating a more solidly mounted system for coupling the strings to a resonating guitar body. The solid connection afforded by the disclosed embodiments allows for the guitar instrument to resonate better, thus transferring the sound to the instrument body and enhancing the played notes. The sound quality is also enhanced due to the solid adjustment of the bridge components allowing for increased harmonic overtone transfer to the instrument pick-ups.

Figure 3A:
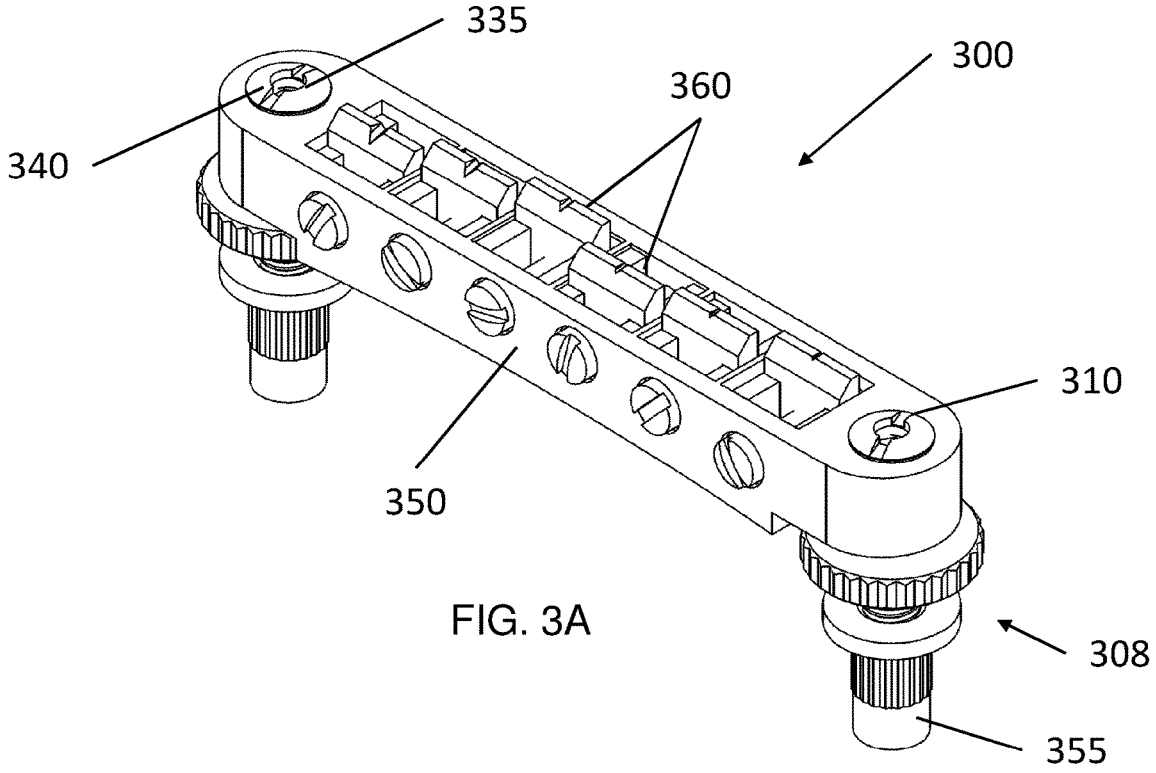
FIGS. 3A and 3B show a perspective view and front view of a bridge assembly in accordance with aspects of the disclosure.
Figure 3B:
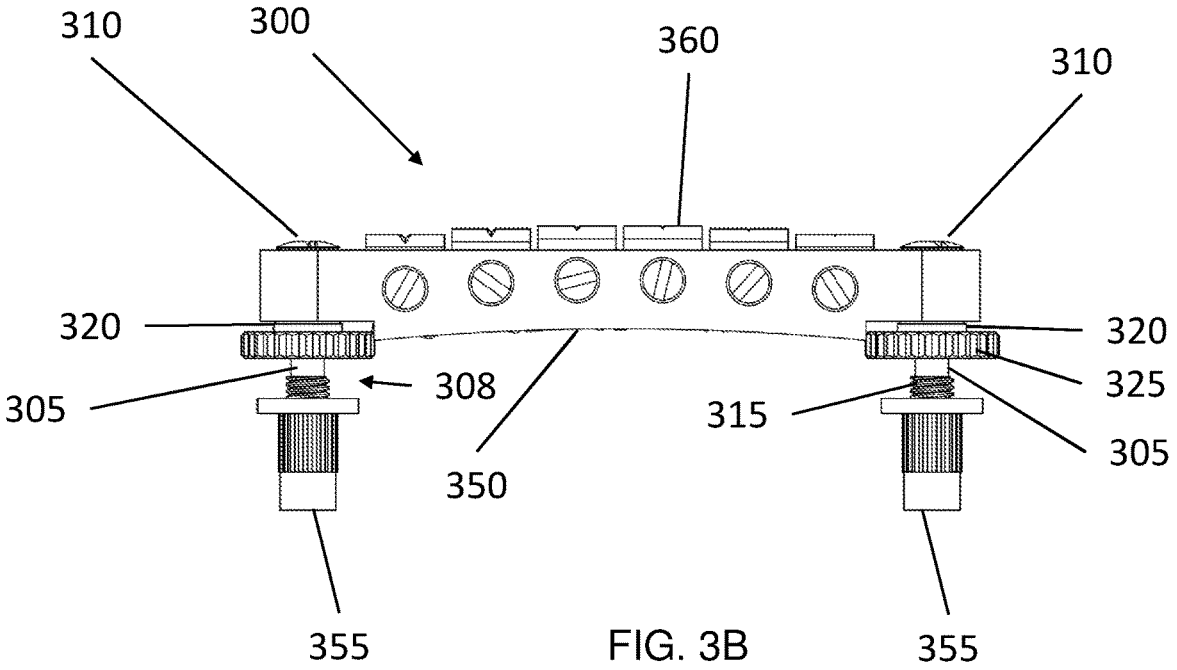

FIGS. 3A and 3B show a perspective view and front view of a fixed bridge assembly 300 in accordance with aspects of the disclosure. As shown in FIGS. 3A and 3B, the fixed bridge assembly 300 includes a fixed bridge (or bridge body) 350 mountable to a stringed-instrument body (not shown) using two bridge post assemblies 308 in accordance with aspects of the disclosure. As shown in FIGS. 3A and 3B, the bridge post assembly 308 includes a lower portion (or bridge post) 305 and an upper cap portion (or cap) 310. As shown in FIGS. 3A and 3B, the bridge post 305 and the cap 310 are fastenable to one another to form the bridge post assembly 308.

As shown in FIG. 3B, the bridge post 305 includes a lower threaded portion 315 configured to be threaded into the body of a musical instrument (e.g., guitar), for example directly or via a grommet 355. The bridge post 305 also includes a support platform 320 that is structured and arranged to support an end of a bridge body 350 thereon. As shown in FIG. 3A, the bridge post 305 also includes an actuating surface (e.g., knurled surface) 325. The bridge post 305 also includes an upper threaded portion (not shown) having external threads structured and arranged for threaded engagement with a corresponding female internally threaded portion (not shown) of the cap 310. When assembled, the bridge post (or stud) assembly 308 provides a securing region for respective ends of a bridge 350. As is also shown in FIGS. 3A and 3B, the bridge assembly 300 includes a plurality of saddles 360 structured and arranged to support respective individual strings (not shown).

Additional string support systems are discussed in commonly-assigned U.S. Pat. No. 10,395,627 entitled "Cap-Style Locking Stud," the content of which is expressly incorporated by reference herein in its entirety.

In accordance with aspects of the disclosure, the bridge post 305 also includes a socket (e.g., a hex socket), which may be used to rotate (e.g., using a hex wrench or Allen wrench) the bridge post 305 so as to adjust the height of the bridge post 305 (or an extent of the threaded engagement of the bridge post 305 with the guitar). That is, instead of rotating the bridge post 305 by contacting an external actuating surface 325, with embodiments of the present disclosure, the bridge post 305 is rotatable by engaging a tool with an internal surface (e.g., the socket) of the bridge post 305. Thus, by implementing this aspect of the disclosure, a user can fasten the bridge post 305 to the guitar body without needing to contact (e.g., with a tool) the external surfaces of the bridge post 305 of the bridge post assembly 308. As such, damage to the bridge post 305 (e.g., to the surface or finish) can be avoided when initially installing the bridge post 305 to the instrument body.

The cap 310 includes an upper receiving and a head. The shaft includes the internally threaded portion (not shown) that is engagable with the upper threaded portion (not shown) of the bridge post 305. In accordance with aspects of the disclosure, the head of the cap 310 may include a through-hole 335 and a slot 340. The slot 340 is configured to receive a tool (e.g., screwdriver) to rotatably engage (e.g., tighten or loosen) the cap 310 to the upper threaded portion of the bridge post 305. When the cap 310 is fastened to the bridge post 305, the cap 310 is operable to secure an end of a bridge body 350 arranged on the support platform 320 to the instrument by pinching the end of the bridge body 350 between the support platform 320 and the head of the cap 310.

In accordance with further aspects of the disclosure, when the cap 310 is fastened to the bridge post 305, the through-hole allows access through the cap 310 to the socket of the bridge post 305. Accordingly, even when the cap 310 is fastened to the bridge post 305, the socket is accessible so as to allow a user to make height adjustments to the bridge post 305 (and thus, height adjustments to the bridge post assembly 308 and the bridge body 350 arranged thereon. Accordingly, by implementing aspects of the disclosure, adjustments to the height at either end (or both ends) of the bridge body 350 may be made without risking damage to external surfaces of the bridge body 350 or the post assemblies 308. Moreover, as access to the height adjustment with the embodiments of the present disclosure is via the top of the bridge post assembly, arranging a tool to make such adjustments is much easier than with conventional approaches that may require access from a side of the bridge post and/or manual (e.g., toolless) adjustment.

When fastened to one another, a securing region is formed between the support platform 320 of the bridge post 305 and the head of the cap 310. The height of the securing region may be structured so as to correspond with an approximate height of the bridge body 350, so that a tightening of the cap 310 to the bridge post 305 "pinches" the bridge body 350, thus securing the bridge body 350 as a part of the bridge assembly 300.

In accordance with further aspects of the disclosure, by utilizing the bridge post assembly 308 having the locking cap 310, the bridge body 350 can be secured to the guitar body, such that when the strings are not passing over the bridge (e.g., when changing strings), the bridge body 350 remains attached to the guitar body.

Figure 4A:
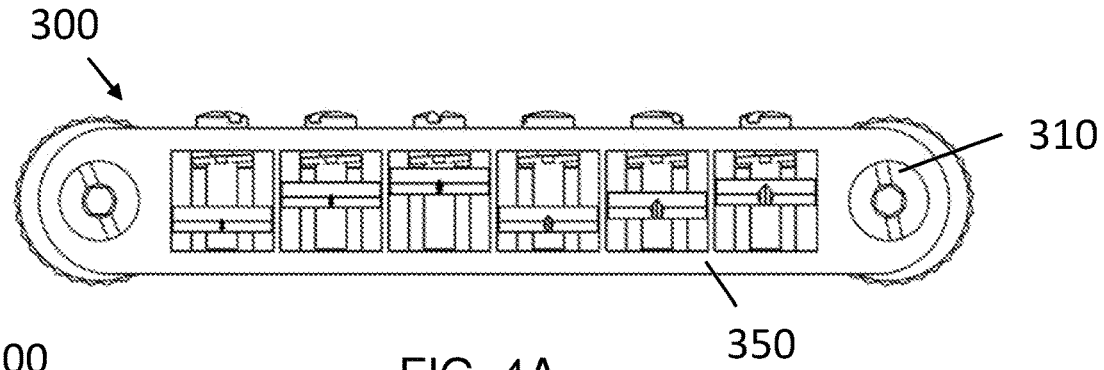
FIGS. 4A-4D respectively show exemplary top, back, bottom, and side views of a bridge assembly in accordance with aspects of the disclosure.
Figure 4B:
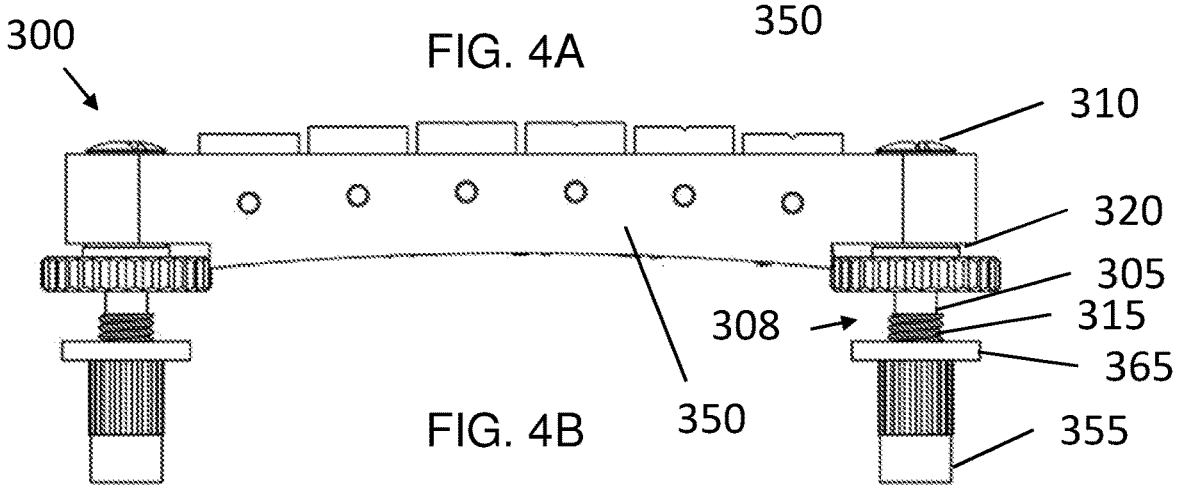
Figure 4C:
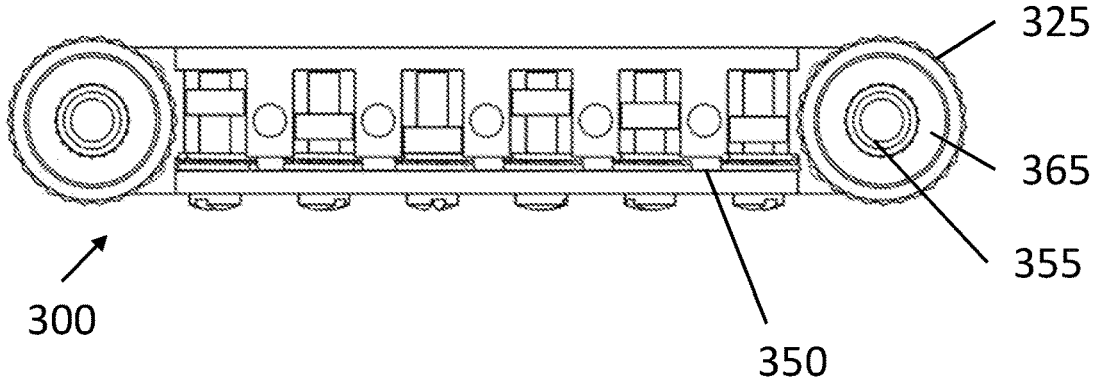
Figure 4D:
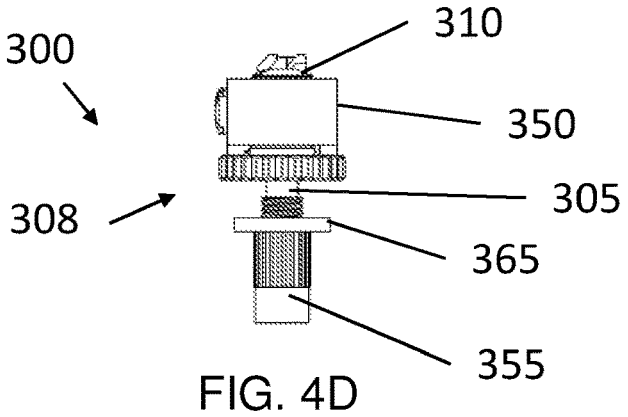

FIGS. 4A-4D respectively show exemplary top, back, bottom, and side views of a bridge assembly 300 in accordance with aspects of the disclosure. As shown in FIGS. 4A, 4B, and 4D, the cap 310 "pinch" the bridge body 350 to the supporting portion 320, thus securing the bridge body 350 to the bridge post assembly 308. As shown in FIG. 4B, the head of the cap 310 includes a slot 340 configured to receive a tool (e.g., screwdriver) to rotatably engage (e.g., tighten or loosen) the cap 310 to the upper threaded portion of the bridge post 305. When the cap 310 is fastened to the bridge post 305, the cap 310 is operable to secure an end of a bridge body 350 arranged on the support platform 320 to the instrument by pinching the end of the bridge body 350 between the support platform 320 and the head of the cap 310.

As shown in FIGS. 4B and 4C, the grommet 355 includes a rim 365. The lower portion 305 includes a recessed region that accommodates the rim 365 when the lower portion 305 is fully lowered into the grommet 355.

Figure 5A:
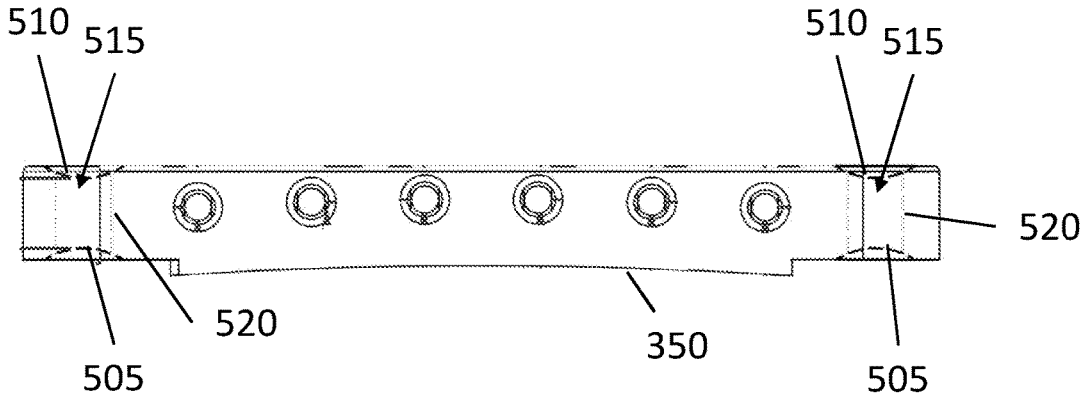
FIGS. 5A-5C show views of components of a bridge assembly in accordance with aspects of the disclosure.
Figure 5B:
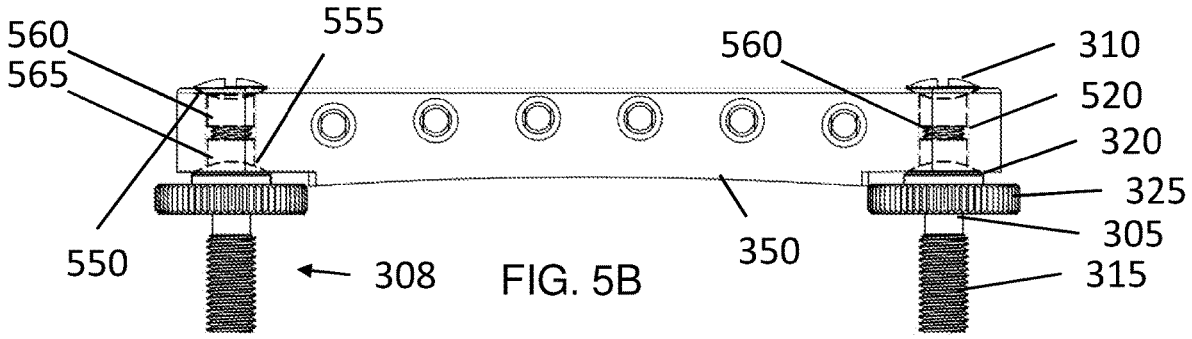
Figure 5C:
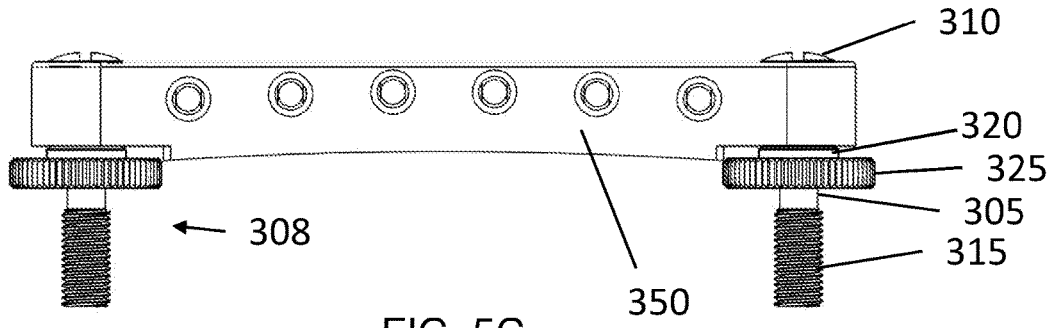

FIGS. 5A-5C show views of components of a bridge assembly in accordance with aspects of the disclosure. FIG. 5A shows a bridge (or bridge body) 350 mountable to a stringed-instrument body (not shown) using two bridge post assemblies (not shown). As shown in FIG. 5A, the bridge body 350 includes mounting holes 515, and in accordance with aspects of the disclosure, the mounting holes (or receiving passages) 515 each include lower and upper recessed contact surfaces or concave inner surfaces (or inner rims), i.e., lower concave recessed contact surfaces 505 and upper concave recessed contact surfaces 510 on the edges of the mounting holes 515.

With an exemplary and non-limiting embodiment, the lower concave surfaces 505 and upper concave surfaces 510 on the edges of the mounting holes 515 have a radius of curvature of 0.265" and the mounting holes 515 have an inner diameter of 0.202". With an exemplary and non-limiting embodiment, the circle formed by the intersection of the lower concave surfaces 505 with the lower face of the bridge body, and upper concave surfaces 510 with the upper faces of the bridge body have a diameter of 0.290". With this exemplary embodiment, the mounting holes 515 have a height of 0.330", and the distance between the peak of the lower concave surfaces 505 and valley of the upper concave surfaces 510 is 0.257". With other exemplary embodiments, the mounting holes may have a height of 0.342".

As shown in FIGS. 5B and 5C, the bridge post assembly 308 includes a bridge post 305 and an cap 310. The bridge post 305 also includes an upper threaded portion 560 having external threads structured and arranged for threaded engagement with a corresponding female internally threaded portion (not shown) of the cap 310. As shown in FIG. 5B, the bridge post 305 and the cap 310 are fastenable to one another to form the bridge post assembly 308. The mounting holes 515 have inner wall surfaces 520 configured for receiving the lower shaft 560 of the cap 310 and the upper shaft 565 of the bridge post 305.

When assembled, the bridge post (or stud) assembly 308 provides a securing region for respective ends of a bridge body 350. As shown in FIGS. 5B and 5C, the bridge post 305 includes a lower threaded portion 315 configured to be threaded into the body of a musical instrument (e.g., guitar), for example directly or via a grommet (not shown). As shown in FIGS. 5B and 5C, the lower portion 305 also includes an actuating surface (e.g., knurled surface) 325.

The bridge post 305 also includes a support platform 320 that is structured and arranged to support an end of a bridge 350 thereon. When fastened to one another, a securing region is formed along the lower receiving shaft of the cap and the upper receiving shaft of the bridge post between the support platform 320 of the bridge post 305 and the head of the cap 310. As shown in FIG. 5B, in accordance with aspects of the disclosure, the support platform 320 has a convex (or rounded) upper surface 555 structured and arranged for engagement with the lower concave edges 505 of the mounting holes 515. In accordance with further aspects of the disclosure, the cap 310 has a convex (or rounded) lower surface 550 structured and arranged for engagement with the upper concave edges 510 of the mounting holes 515. Thus, in accordance with aspects of the disclosure, as shown in FIG. 5B, when the bridge post 305 and the cap 310 are fastened to one another, a bridge securing region is formed along the lower receiving shaft and the upper receiving shaft between the upper surface 555 of the support platform 320 and the convex (or rounded) lower surface 550 of the cap 310. The upper surface 555 of the support platform 320 engages with the lower concave edges 505 of the mounting holes 515, and the convex (or rounded) lower surface 550 of the cap 310 engages with upper concave edges 510 of the mounting holes 515. Thus, in contrast to conventional bridge systems, which utilize planar engagement (i.e., in which a planar support surface of a bridge post supports a planar lower surface of the bridge body), embodiments of the present disclosure utilize a curved or rounded engagement between the bridge posts and the bridge (e.g., in which a rounded convex support upper surface 555 of a bridge post supports a correspondingly rounded concave lower surface 505 of the bridge body and/or a convex (or rounded) lower surface 550 of the cap 310 engages with correspondingly rounded upper concave surface 510 of the mounting hole 515 of the bridge body 350).

In some embodiments, the outer diameters of the lower receiving shaft and the upper receiving shaft are approximately equal to one another, and correspond with an internal diameter of the mounting holes 515 on the bridge body 350. In some embodiments, the mounting holes 515 may be configured so as to minimize any longitudinal and/or lateral movement of the bridge 350 attached to the respective bridge assemblies 308 in accordance with certain aspects of the disclosure.

Figure 6A:
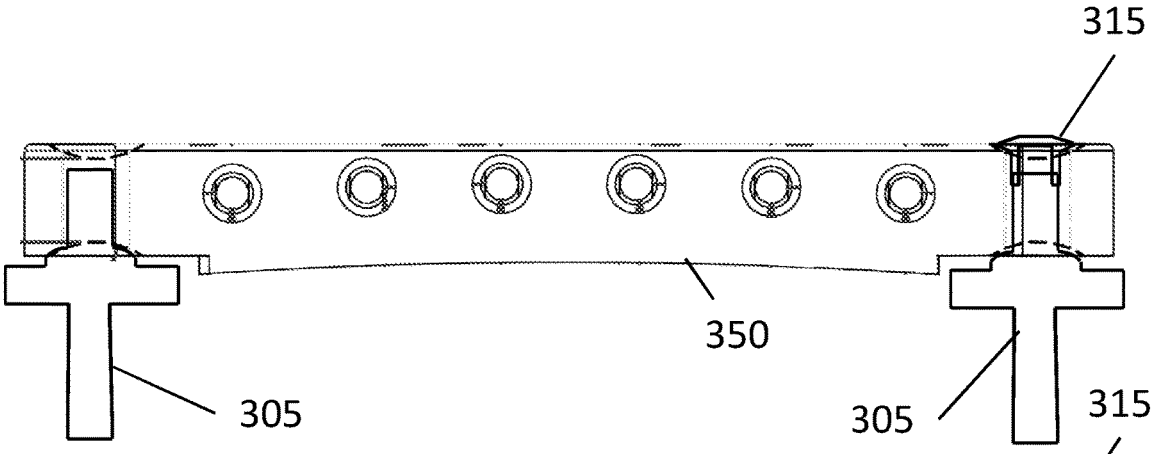
FIGS. 6A-6C schematically depict a bridge assembly arranged in parallel and non-parallel manners in accordance with aspects of the disclosure, and FIG. 6D schematically depicts components of a bridge assembly in accordance with aspects of the disclosure.
Figure 6B:
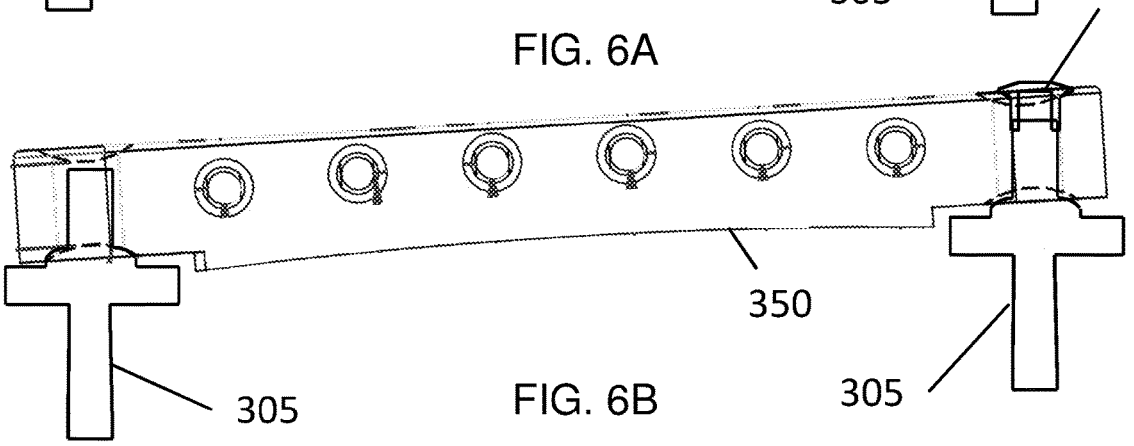
Figure 6C:
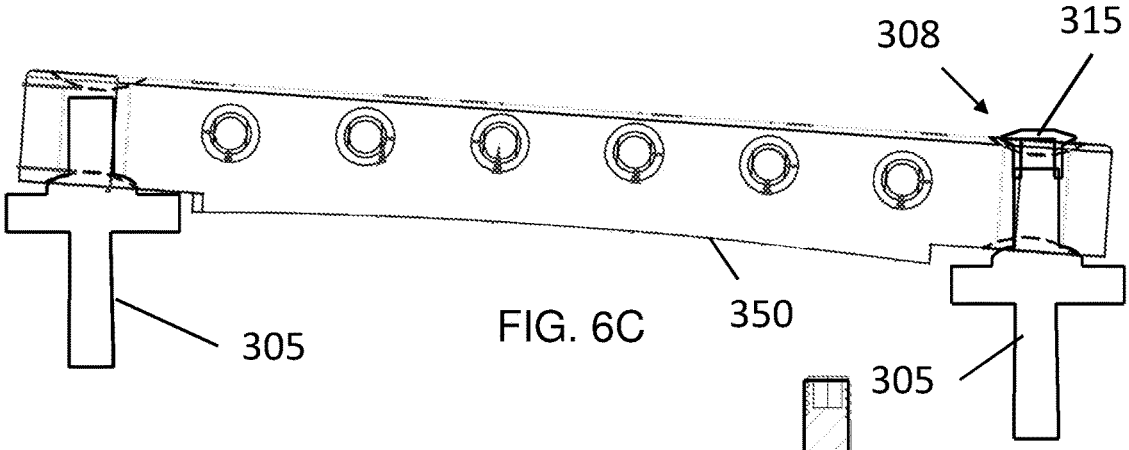
Figure 6D:
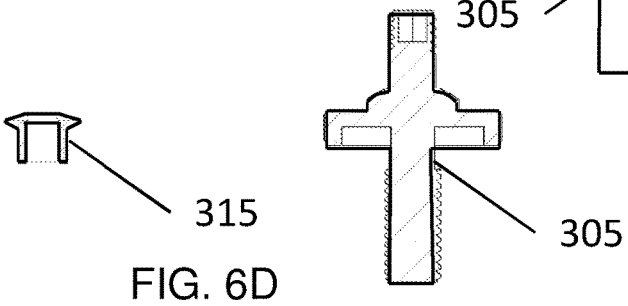

FIGS. 6A-6C schematically depict a bridge body 350 arranged in parallel and exemplary non-parallel orientations in accordance with aspects of the disclosure, and FIG. 6D schematically depicts components (i.e., cap 315 and bridge post 305) of a bridge post assembly 308 in accordance with aspects of the disclosure. To aid in understanding aspects of the present disclosure, the right-hand sides of the exemplary orientations include fully-depicted schematic representations of the bridge post assemblies 308, whereas the left-hand sides of the exemplary orientations schematically depict only bridge posts 305.

FIG. 6A schematically depicts a bridge body 350 arranged in parallel orientation, wherein each of the bridge posts 305 is arranged at a common height. When a user desires to have one end of the bridge body 350 to be higher than the other end, the height of one of the bridge posts may be adjusted to a different height than the other bridge posts. For example, as schematically depicted in FIG. 6B, due to the relative heights of the bridge posts 305 (and the support surfaces thereof) the right-hand side of the bridge body 350 is higher than the left-hand side. In contrast, as schematically depicted in FIG. 6C, due to the relative heights of the bridge posts 305 (and the support surfaces thereof) the right-hand side of the bridge body 350 is higher than the left-hand side. As noted above, a user may desire to adjust the orientation of the bridge to achieve a desired string height, e.g., for different desired playing styles.

In accordance with aspects of the disclosure, by providing the upper concave surface 555 of the support platform 320 that is engagable with the lower concave edges 505 of the mounting holes 515, and providing the convex (or rounded) lower surface 550 of the cap 310 that is engagable with upper concave edges 510 of the mounting holes 515, embodiments of the present disclosure utilize a curved or rounded engagement between the bridge post assemblies and the bridge body. Thus, in accordance with aspects of the disclosure, as shown in FIGS. 6A-6C, secure contact between the bridge body 350 and the bridge post assemblies 308 is achievable even when the bridge body 350 is arranged in a relatively non-parallel manner. That is, the curved engagement surfaces allow for some degree of relative pivoting or tilting between the bridge body 350 and the bridge post assemblies 308, while still providing areal engagement between the bridge body 350 and the bridge post assemblies 308.

Thus, in contrast to conventional bridge systems, which utilize planar engagement (i.e., in which a planar support surface of a bridge post supports a planar lower surface of the bridge body), embodiments of the present disclosure utilize a curved or rounded engagement between the bridge posts and the bridge (e.g., in which a rounded convex support upper surface 555 of a bridge post supports a correspondingly rounded concave lower surface 505 of the bridge body and/or a convex (or rounded) lower surface 550 of the cap 310 engages with correspondingly rounded upper concave surface 510 of the mounting hole 515 of the bridge body 350).

Figure 7:
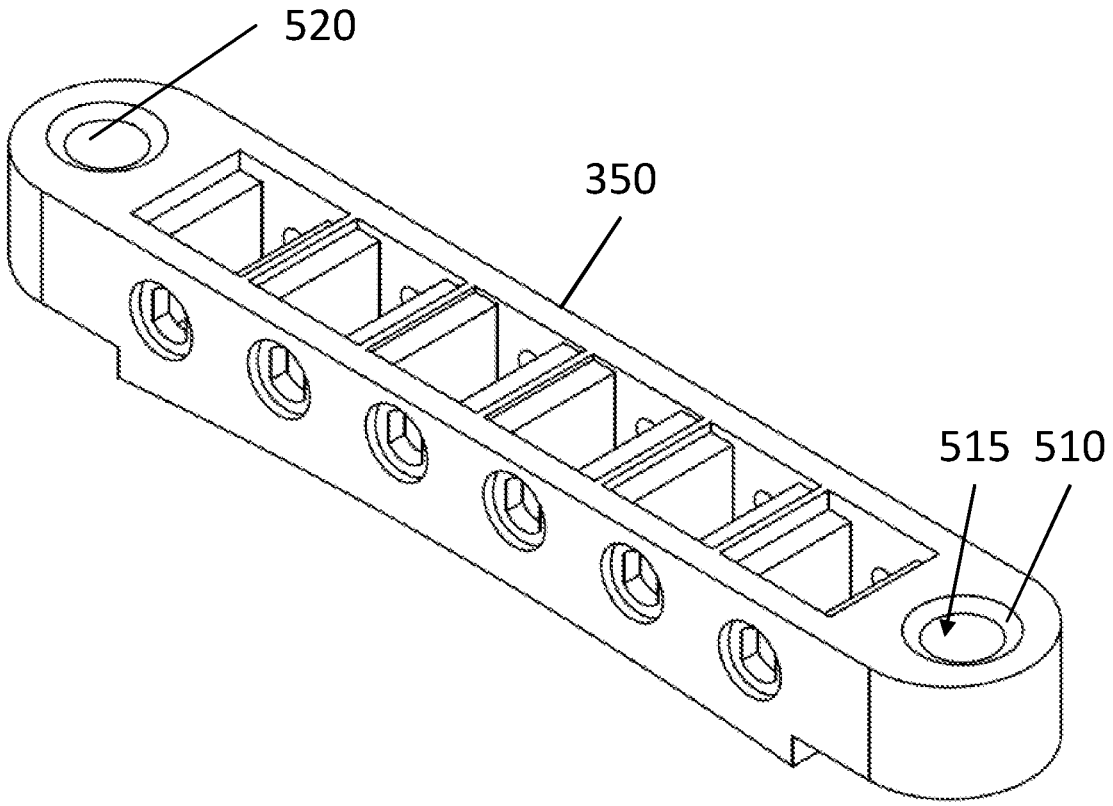
FIG. 7 shows a perspective view of a "Nashville" bridge body of a bridge assembly in accordance with aspects of the disclosure.
Figure 8A:
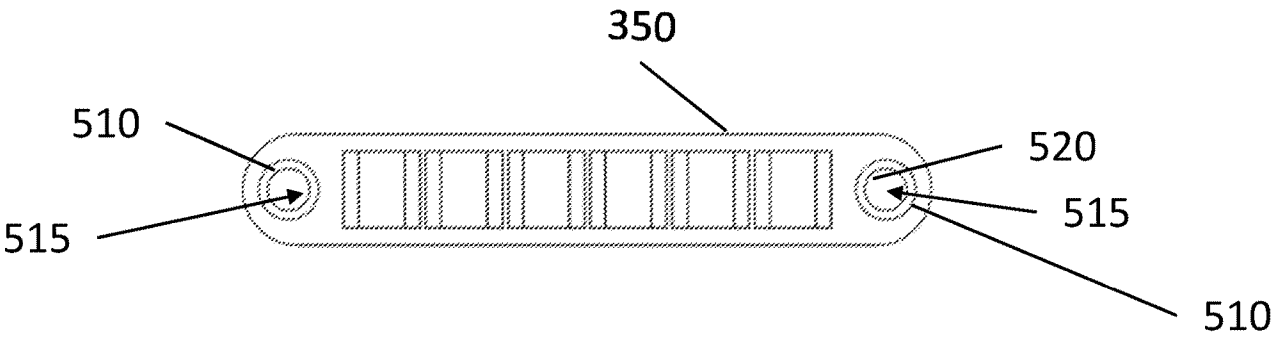
FIGS. 8A-8D show various views of a Nashville bridge body of a bridge assembly in accordance with aspects of the disclosure.
Figure 8B:
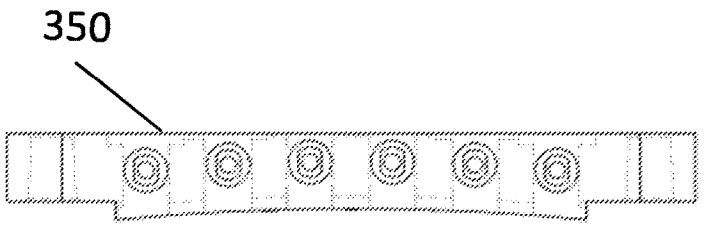
Figure 8C:
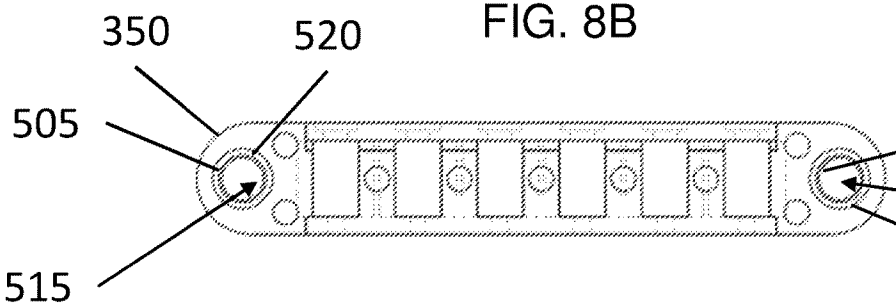
Figure 8D:
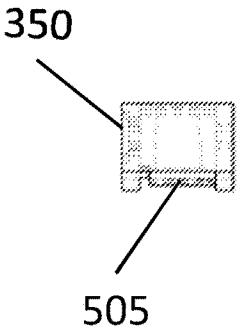

FIG. 7 shows a perspective view of a "Nashville" bridge body 350 of a bridge assembly in accordance with aspects of the disclosure. As shown in FIG. 7, the bridge body 350 includes two mounting holes (or receiving passages) 515. In accordance with aspects of the disclosure, the mounting holes 515 each include concave inner surfaces (or inner rims), i.e., lower concave surfaces (not shown) and upper concave surfaces 510 on the edges of the mounting holes 515. The mounting holes 515 have inner wall surfaces 520 and are configured for receiving portions of the cap (not shown) and portions of the bridge posts (not shown).

FIGS. 8A-8D show various views of a Nashville bridge body 350 of a bridge assembly in accordance with aspects of the disclosure. As shown in the top view of FIG. 8A, the mounting holes 515 each include upper concave surfaces 510 on the edges of the mounting holes 515. The mounting holes 515 have inner wall surfaces 520 and are configured for receiving portions of the cap (not shown) and portions of the bridge posts (not shown). As shown in the bottom view of FIG. 8C, the mounting holes 515 each include lower concave surfaces 505 on the edges of the mounting holes 515.

Figure 9:
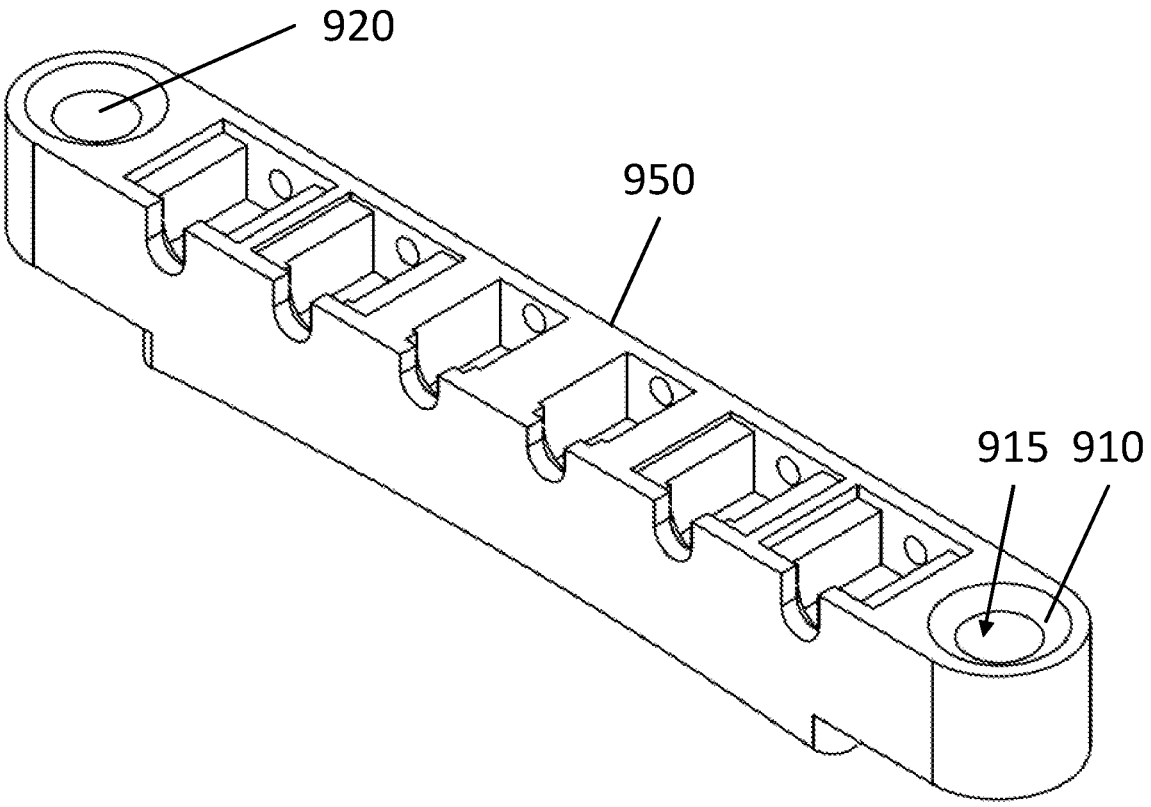
FIG. 9 shows a perspective view of an ABR bridge body of a bridge assembly in accordance with aspects of the disclosure.

FIG. 9 shows a perspective view of an ABR-1 bridge body of a bridge assembly in accordance with aspects of the disclosure. As shown in FIG. 9, the bridge body 950 includes two mounting holes 915. In accordance with aspects of the disclosure, the mounting holes 915 each include, on the edges of the mounting holes 915, concave inner surfaces (or inner rims), i.e., lower concave surfaces (not shown) and upper concave surfaces 910. The mounting holes 915 have inner wall surfaces 920 and are configured for receiving portions of the upper cap portion (not shown) and portions of the lower portion (not shown).

FIGS. 10A-10F show various views of an exemplary ABR bridge body of a bridge assembly in accordance with aspects of the disclosure. As shown in the top view of FIG. 10A, the mounting holes (or passage) 915 each include upper concave surfaces 910 on the edges of the mounting holes 915. The mounting holes 915 have side wall surfaces 920 configured for receiving portions of the cap (not shown) and portions of the bridge posts (not shown). As shown in the bottom view of FIG. 10C, the mounting holes 915 each include lower concave surfaces 905 on the edges of the mounting holes 915.

Figure 10A:
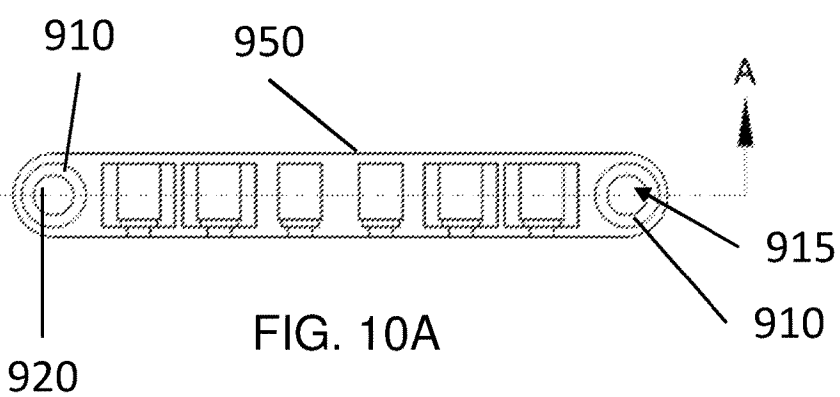
FIGS. 10A-10F show various views of an ABR bridge body of a bridge assembly in accordance with aspects of the disclosure.
Figure 10B:
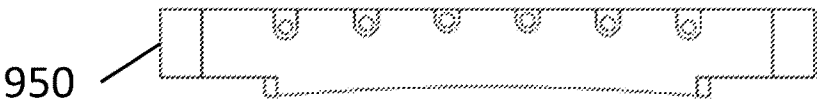
Figure 10C:
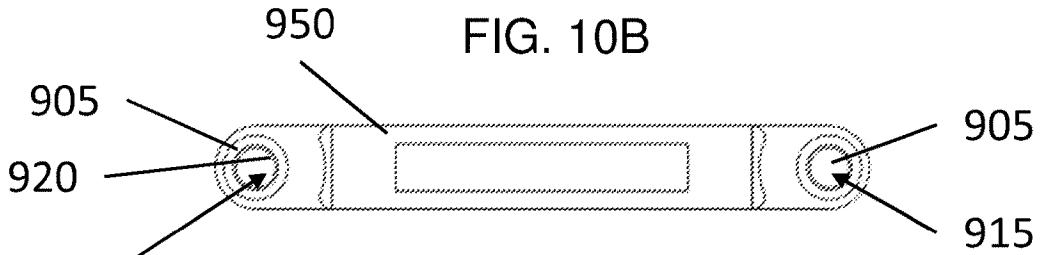
Figure 10D:
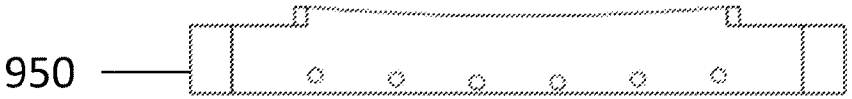
Figure 10E:
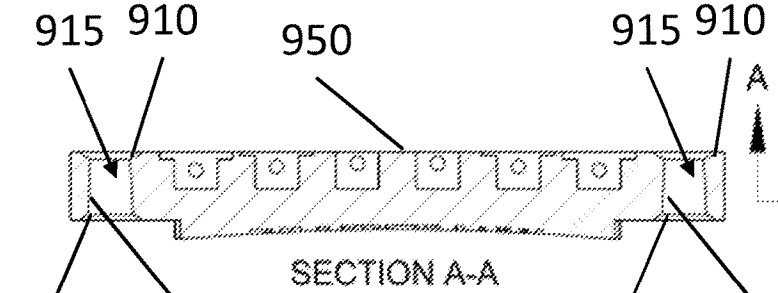
Figure 10F:
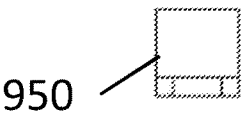

As shown in the sectional view of FIG. 10E, in certain embodiments, in accordance with aspects of the disclosure, the mounting holes 915 have inner side wall surfaces 920 that taper outwardly from the top of the bridge body 950 towards the bottom of the bridge body. That is, the diameter at the top of the mounting passage (or receiving passage) 915 is smaller than the diameter at the bottom of the mounting passage 915. The widening passage increases the range of motion of the bridge body 350 on the bridge posts (not shown). That is, the tapered side wall surfaces 920 permit the bridge body 950 to be mounted to the bridge posts (not shown) over a greater range of orientations (e.g., non-parallel orientations), while still providing sufficient areal contact (due to the rounded surface contact) between the bridge body 950 and the bridge post assemblies (not shown).

With an exemplary and non-limiting embodiment, the tapered mounting holes 915 may have a 0.202" diameter towards the top of the bridge body and a 0.231" diameter towards the bottom of the bridge body.

Figure 11A:
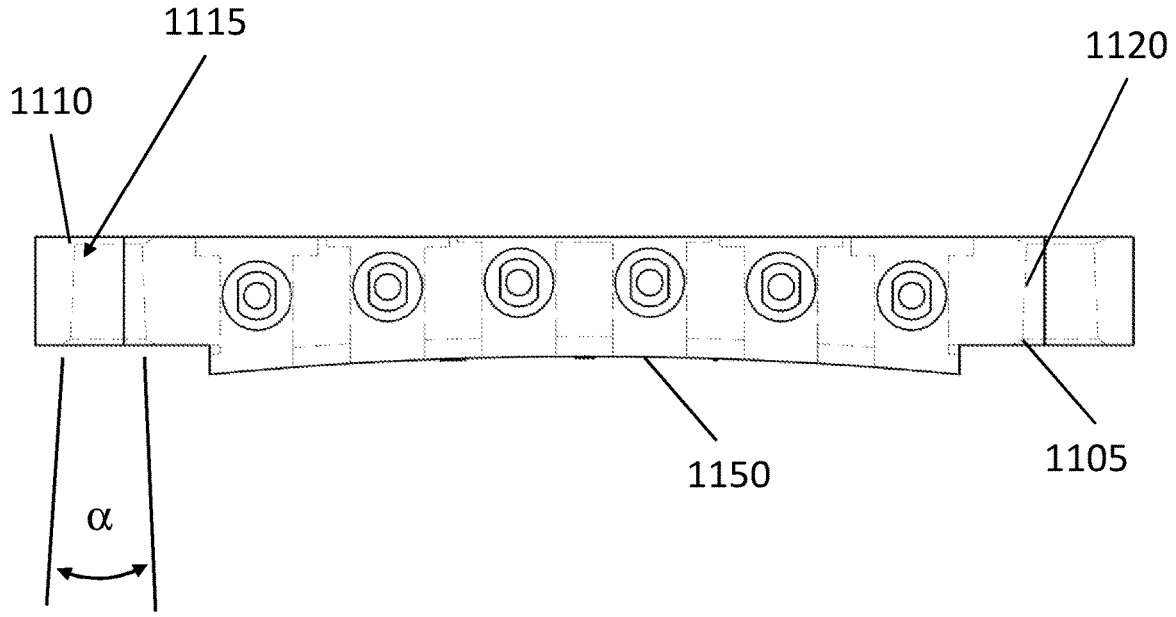
FIGS. 11A and 11B show views of a Nashville bridge body and an ABR bridge body, respectively, in accordance with aspects of the disclosure.
Figure 11B:
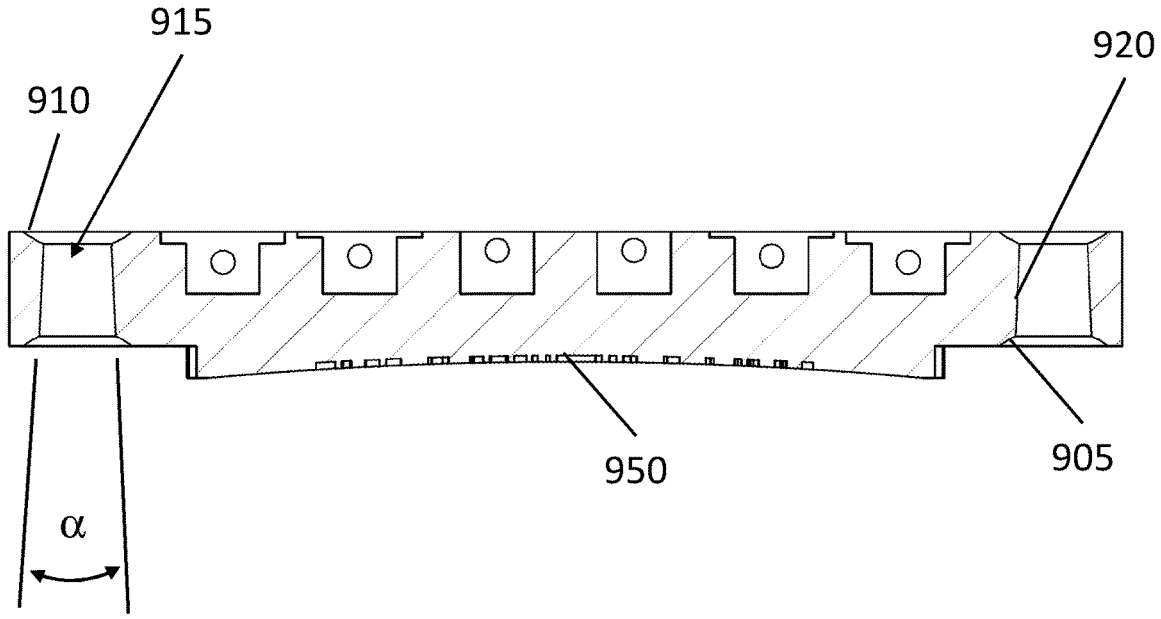

FIGS. 11A and 11B show views of a Nashville bridge body 1150 and an ABR bridge body 950, respectively, in accordance with aspects of the disclosure. As shown in FIGS. 11A and 11B, the mounting holes (or passages) 1115 and 915 are tapered. In accordance with aspects of the disclosure, the tapered side wall surfaces 1120, 920 permit the bridge body 1150, 950 to be mounted to the bridge posts (not shown) over a greater range of orientations (e.g., non-parallel orientations), while still providing sufficient areal contact (due to the rounded surface contact) between the bridge body 1150, 950 and the bridge post assemblies (not shown). For example, as depicted in FIGS. 11A and 11B, the bridge posts may be arranged relative to the bridge body within the angular range a.

Additionally, in accordance with further aspects of the disclosure, while FIGS. 11A and 11B depict the angular range of orientation a in a plane parallel to the longitudinal axis of the bridge, the convex and concave engagement surfaces described herein and the tapered mounting holes (or passages) 1115 and 915 may also provide a range of bridge orientation over an angular range in a plane parallel to the longitudinal axis of the instrument. That is, in embodiments, the bottom of the bridge body may be tilted towards or away from, e.g., the tailpiece or the nut, within the angular range of orientation a to achieve a non-vertical orientation.

In accordance with further aspects of the disclosure, the components of the bridge assembly may be configured for interchangeability. For example, as can be observed from FIGS. 11A and 11B, the mounting holes (or receiving passages) 1115 and 915 of the bridge bodies 1150, 950 have a common size, such that either bridge body 1150, 950 may be mounted to a commonly-sized bridge post. In such a manner, in accordance with aspects of the disclosure, a user can utilize the different styles of bridge bodies (e.g., ABR-1 and/or Nashville bridges, amongst other contemplated bridge styles) without needing to replace all of the bridge mounting hardware.

FIGS. 12A-12D show various views of a bridge post and cap of a bridge assembly in accordance with aspects of the present disclosure. More specifically, FIGS. 12A and 12B show top and side views of a bridge post 305 and upper cap 310 of a bridge post assembly 308 and FIGS. 12C and 12D show top and side views of a bridge post 305 in accordance with aspects of the present disclosure. As shown in FIGS. 12A and 12B, the post assembly 308 includes a bridge post 305 and a cap 310. As shown in FIGS. 12A and 12B, the bridge post 305 and the cap 310 are fastenable to one another to form the bridge post assembly 308.

As shown in FIGS. 12B and 12D, the bridge post 305 includes a lower threaded portion 315 configured to be threaded into the body of a musical instrument (e.g., guitar), for example directly or via a grommet (not shown). The bridge post 305 also includes a support platform 320 that is structured and arranged to support an end of a bridge body 350 thereon. As shown in FIGS. 12B and 12D, in accordance with aspects of the disclosure, the support platform 320 has a convex (or rounded) upper surface 555 structured and arranged for engagement with the lower concave edges of the mounting holes of the bridge body (not shown). In accordance with further aspects of the disclosure, the cap 310 has a convex (or rounded) lower surface 550 structured and arranged for engagement with the upper concave edges of the mounting holes of the bridge body (not shown). Thus, in accordance with aspects of the disclosure, as shown in FIG. 12B, when the bridge post 305 and the cap 310 are fastened to one another, a bridge securing region is formed along the lower receiving shaft and the upper receiving shaft between the upper surface 555 of the support platform 320 and the convex (or rounded) lower surface 550 of the cap 310. The upper surface 555 of the support platform 320 is configured for engagement with the lower concave edges of the mounting holes of the bridge body (not shown), and the convex (or rounded) lower surface 550 of the cap 310 is configured for engagement with upper concave edges of the mounting holes of the bridge body (not shown). Thus, as shown in FIGS. 12B and 12D, embodiments of the present disclosure utilize a curved or rounded engagement between the bridge posts and the bridge (e.g., in which a rounded convex support upper surface 555 of a bridge post supports a correspondingly rounded concave lower surface of the bridge body and/or a convex (or rounded) lower surface 550 of the cap 310 engages with correspondingly rounded upper concave surface of the mounting holes of the bridge body).

As shown in FIGS. 12B and 12D, the bridge post 305 also includes an actuating surface (e.g., knurled surface) 325. The bridge post 305 also includes an upper threaded portion 560 having external threads structured and arranged for threaded engagement with a corresponding female internally threaded portion (not shown) of the cap 310. The cap 310 includes a shaft portion and a head, wherein the internally threaded portion is provided in the shaft portion.

In accordance with aspects of the disclosure, as shown in FIGS. 12A and 12B the bridge post 305 also includes a socket (e.g., a hex socket), which may be used to rotate (e.g., using a hex wrench or Allen wrench) the bridge post 305 so as to adjust the height of the bridge post 305 (or an extent of the threaded engagement of the bridge post 305 with the guitar). In accordance with aspects of the disclosure, the head of the cap 310 may include a through-hole 335 and a slot 340. The slot 340 is configured to receive a tool (e.g., screwdriver) to rotatably engage (e.g., tighten or loosen) the cap 310 to the upper threaded portion of the bridge post 305. As shown in FIG. 12A when the cap 310 is fastened to the bridge post 305, the through-hole allows access through the cap 310 to the socket of the bridge post 305. Accordingly, even when the cap 310 is fastened to the bridge post 305, the socket is accessible so as to allow a user to make height adjustments to the bridge post 305 (and thus, height adjustments to the bridge post assembly 308 and the bridge body 350 arrangable thereon).

When fastened to one another, a securing region is formed between the support platform 320 of bridge post 305 and the head of the cap 310. The height of the securing region may be structured so as to correspond with an approximate height of the bridge body, so that a tightening of the cap 310 to the bridge post 305 "pinches" the bridge body, thus securing the bridge body 350 as a component of the bridge assembly 300.

FIGS. 13A-13E show various views of a bridge post (or lower portion of the bridge post assembly) 305 in accordance with aspects of the present disclosure. As shown in FIGS. 13B-13E, the bridge post 305 includes a lower threaded portion 315 configured to be threaded into the body of a musical instrument (e.g., guitar), for example directly or via a grommet (not shown). The bridge post 305 also includes a support platform 320 that is structured and arranged to support an end of a bridge body 350 thereon. As shown in FIGS. 13A, 13B, 13D, and 13E, the support platform 320 has a convex (or rounded) upper surface 555 structured and arranged for engagement with the lower concave edges of the mounting holes of the bridge body (not shown). The upper surface 555 of the support platform 320 is configured for engagement with the lower concave edges of the mounting holes of the bridge body (not shown). In accordance with aspects of the disclosure, as shown in FIGS. 13A, 13B, and 13E, the bridge post 305 also includes a socket 335 (e.g., a hex socket), which may be used to rotate (e.g., using a hex wrench or Allen wrench) the bridge post 305 so as to adjust the height of the bridge post 305 (or an extent of the threaded engagement of the bridge post 305 with the guitar).

As shown in the sectional view of FIG. 13E, in embodiments, the bridge post 305 includes a recessed area 1305 having an inner wall 360. The recessed area 1305 is configured to accommodate a rim of a grommet (not shown) when the bridge post 305 is fully lowered into the grommet.

With an exemplary and non-limiting embodiment, the lower threaded portion 315 of the bridge post 305 has a diameter of 0.496". The support platform 320 has a base height of 0.036" from which the rounded (convex) portion rises with a radius of curvature of 0.265". With the exemplary and non-limiting embodiment, the socket 335 has an width of 0.098" and a depth of 0.110". With the exemplary and non-limiting embodiment, the actuating surface (e.g., knurled surface) 325 has a thickness of 0.124" and includes a recessed area having a depth of 0.065". With the exemplary and non-limiting embodiment, the bridge post 305 also includes an upper threaded portion 560 having external threads structured and arranged for threaded engagement with a corresponding female internally threaded portion (not shown) of the cap 310.

Figure 14A:
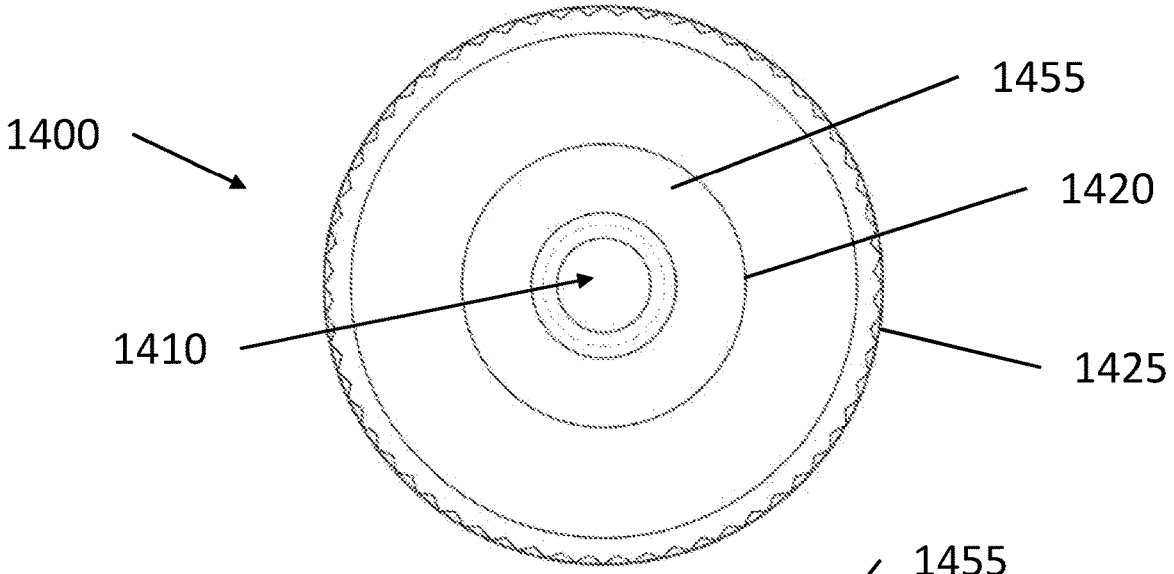
FIGS. 14A-14C show various views of a bridge support in accordance with aspects of the present disclosure.
Figure 14B:
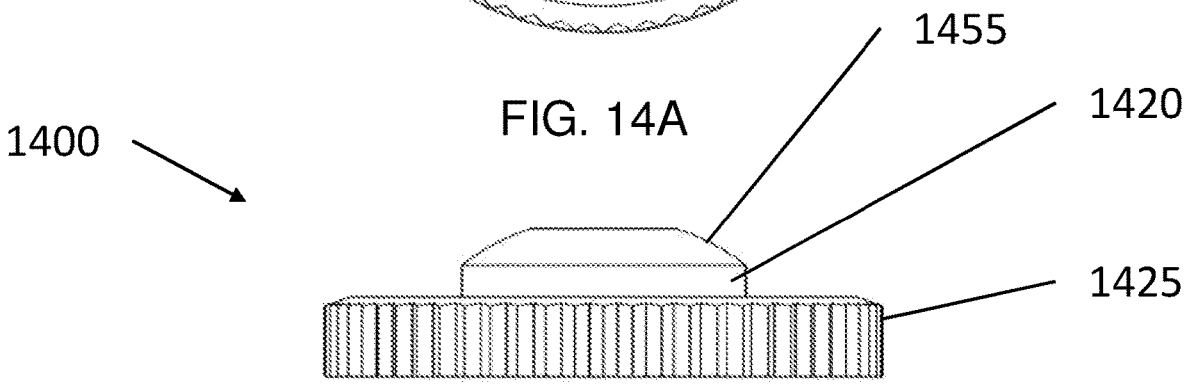
Figure 14C:
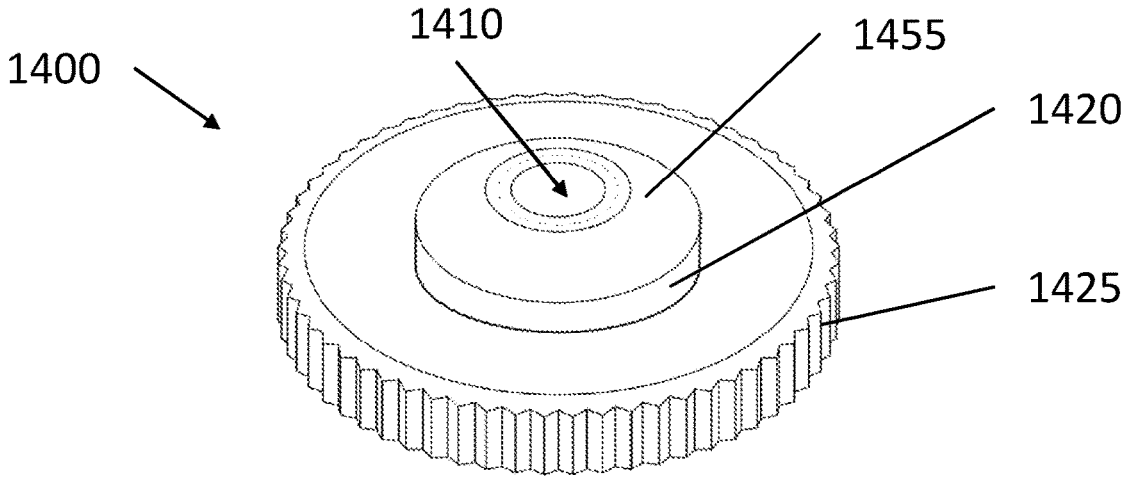
Figure 15A:
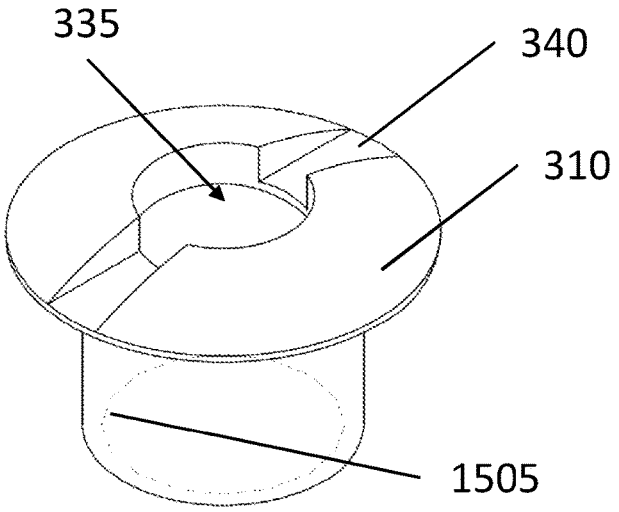
FIGS. 15A-15F show various views of an upper cap of a bridge assembly in accordance with aspects of the present disclosure.
Figure 15D:
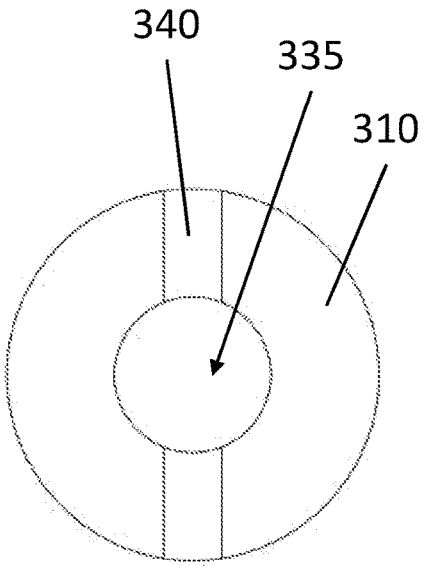
Figure 15B:
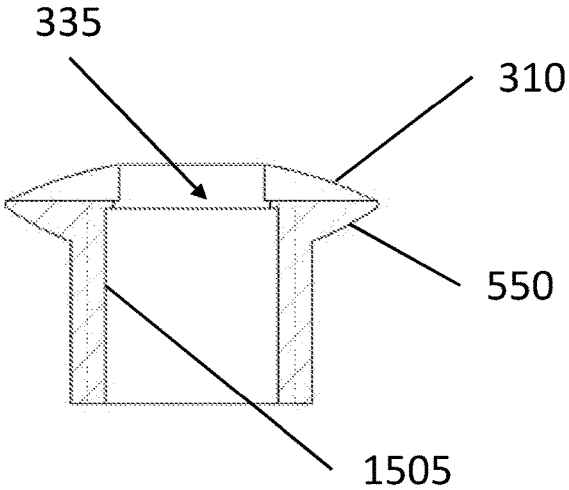
Figure 15E:
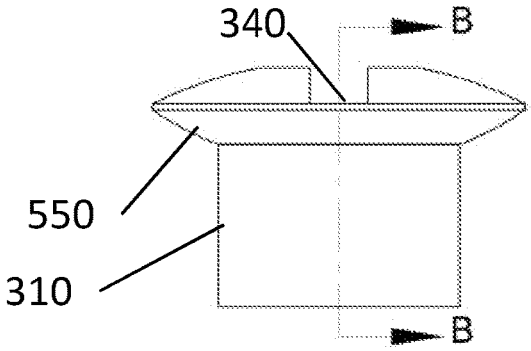
Figure 15C:
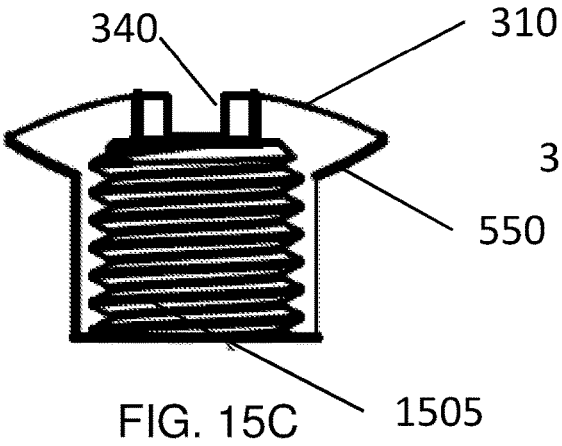
Figure 15F:
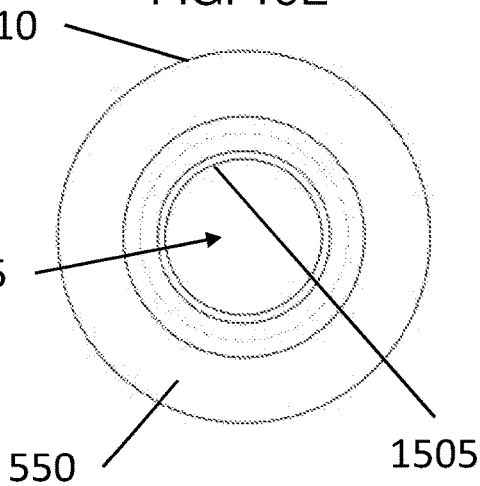

FIGS. 14A-14C show various views of a bridge support 1400 in accordance with aspects of the present disclosure. The bridge support 1400, for example, may be used to support a bridge body having the concave support regions. As shown in 14A-14C, the bridge support 1400 includes a support platform 1420 that is structured and arranged to support an end of a bridge body thereon. As shown in FIGS. 14A-14C, the bridge support 1400 has a convex (or rounded) upper surface 1455 structured and arranged for engagement with the lower concave edges of the mounting holes of the bridge body (not shown). The bridge support 1400 also includes a mounting hole 1410 configured for receiving a mounting post. In accordance with aspects of the disclosure, in embodiments, the bridge support 1400 may be used to retrofit a conventional bridge post so as to accommodate the improved bridge body of the present disclosure having the concave mounting surfaces.

FIGS. 15A-15F show various views of an cap 310 of a bridge assembly in accordance with aspects of the present disclosure. As shown in FIGS. 15A-15F, the cap 310 includes an upper receiving shaft (not shown) and a head. The shaft includes the internally threaded portion 1505 that is engagable with the upper threaded portion of the bridge post (not shown). In accordance with aspects of the disclosure, the head of the cap 310 includes a slot 340, and in certain embodiments, the head of the cap 310 may also include a through-hole 335. The slot 340 is configured to receive a tool (e.g., screwdriver) to rotatably engage (e.g., tighten or loosen) the cap 310 to the upper threaded portion of the bridge post (not shown). The cap 310 has a convex (or rounded) lower surface 550 structured and arranged for engagement with the upper concave edges of the mounting holes (not shown).

FIGS. 16A-16D show various views of another cap of a bridge assembly in accordance with aspects of the present disclosure. As shown in FIGS. 16A-16D, the upper cap 1610 includes an upper shaft and a head. The shaft includes the internally threaded portion 1605 that is engagable with the upper threaded portion of the bridge post (not shown). In accordance with aspects of the disclosure, the head of the cap 1610 includes a slot 1640. The slot 1640 is configured to receive a tool (e.g., screwdriver) to rotatably engage (e.g., tighten or loosen) the cap 1610 to the upper threaded portion of the lower portion (not shown). The cap 1610 has a convex (or rounded) lower surface 1650 structured and arranged for engagement with the upper concave edges of the mounting holes (not shown). With the exemplary embodiment of FIGS. 16A-16D, the cap 1610 does not include a through-hole.

With an exemplary and non-limiting embodiment, the internally threaded portion 1605 the cap may have a 8-32 or 18-8 UNC thread and is 0.154" deep. Additionally, with an exemplary and non-limiting embodiment, the cap has an outer diameter of 0.293", the through-hole has a diameter of 0.123", and the slot has a width of 0.046". With an exemplary and non-limiting embodiment, the cap has a shaft diameter of 0.190", a shaft height of 0.128", and an overall height of 0.191". With an exemplary and non-limiting embodiment, the lower curved surface has a radius of curvature of 0.265", and the upper curved surface of the cap has a radius of curvature of 0.316". The lower curved surface projects downwardly from a height of 0.155" from the base of the cap.

FIGS. 17A-17D show various views of an exemplary grommet 355 of a bridge assembly in accordance with aspects of the present disclosure. As shown in FIGS. 17A-17D, the grommet 355 includes a rim 365 and a friction engagement surface 1715. Additionally, the grommet 355 includes a threaded mounting hole 1705, which is structured and arranged to receive the lower threaded portion of the lower portion (not shown). That is, while not shown in the depictions of FIGS. 17A, 17C, and 17D, it should be understood that the mounting hole 1705 includes an internally threaded wall surface. As shown FIGS. 17A, 17C, and 17D, in embodiments, the grommet 355 may include upper tapered surface 1710 and lower tapered surface 1720.

With an exemplary and non-limiting embodiment, the grommet 355 has a diameter of 0.262" with a diameter of the friction engagement surface 1715 of 0.275", and an overall height of 0.520". With an exemplary and non-limiting embodiment, the rim 365 has a height of 0.069" and a diameter of 0.472". With an exemplary and non-limiting embodiment, the threaded mounting hole 1705 has a diameter of 0.236".

Furthermore, a stringed musical instrument may have other adjustable components (e.g., bridge) with different adjustable parameters (e.g., height of bridge, saddle position adjustments for intonation) with corresponding tool sockets (e.g., hex sockets). As such, many of these adjustments to the tailpiece, for example, are made using a hex wrench (e.g., a commonly-sized hex wrench). In accordance with aspects of the disclosure, by utilizing a bridge assembly that is also adjustable using a hex wrench (e.g., a commonly-sized hex wrench), the number of different tools necessary for making these adjustments to the instrument (e.g., to the tailpiece and/or the bridge) may be reduced.

In embodiments, the materials for the bridge assembly components (e.g., monolithic bridge body, bridge post assemblies, saddles) may include aluminum, zinc (e.g., die cast zinc), brass, steel (e.g., mild steel), and/or other various metals. The bridge assembly components may include one or more of a variety of finishes including, for example, gold, nickel, chrome, black chrome, and/or black nickel.

The components described herein are also designed to fit or retrofit most instruments without any modification to the original instrument. Even expensive "vintage" instruments can be fitted with the new components without any modification to the instrument, and the use of the new components does not detract from the "vintage" look of the instrument. The new components may be constructed to make visual detection of any difference between original stock components and the new components difficult. The new components are easy to use, install, and adjust by a purchaser. A professional installation and adjustment of the components is likely not needed after the first such installation and adjustment, as the instrument owner or user can perform the installation and maintenance.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel architecture is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure has been described with reference to specific embodiments, those skilled in the art will understand that various changes may be made and equivalents may be substituted for elements thereof without departing from the true spirit and scope of the disclosure. While exemplary embodiments are described above, it is not intended that these embodiments describe all possible forms of the embodiments of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

While the specification describes particular embodiments of the present disclosure, those of ordinary skill can devise variations of the present disclosure without departing from the inventive concept. For example, while the disclosure describes the mounting posts in the context of guitars, the inventors contemplate that the mounting posts may be utilized on a myriad of stringed instruments, including, for example and without limitation, bass guitars, mandolins, and dobroes. Furthermore, while embodiments of the disclosure utilize a bridge post and cap to secure the bridge body as part of the bridge assembly, some embodiments may utilize the bridge post (with a convex support surface) to support the bridge body (having corresponding concave surfaces) without utilizing the caps to lock the bridge body to the bridge posts. Instead, with such contemplated embodiments, other locking techniques may be utilized to secure the bridge body to the bridge posts (e.g., set screws passing through the bridge body to contact the bridge posts).

Insofar as the description above and the accompanying drawing disclose any additional subject matter that is not within the scope of the claims below, the embodiments are not dedicated to the public and the right to file one or more applications to claim such additional embodiments is reserved.

What is claimed is:

1. A bridge body for a bridge assembly for a stringed instrument, the bridge body comprising:

a plurality of saddle regions arranged in the bridge body, each of the saddle regions configured to accommodate a saddle;

two receiving passages that pass through the bridge body from an upper side of the bridge body to a lower side of the bridge body; and upper recessed contact surfaces respectively arranged at upper ends of the receiving passages, wherein the bridge body comprises a bottom surface, wherein the bottom surface includes a central region bottom surface and two receiving passage region bottom surfaces, and wherein the central region bottom surface is arranged between the two receiving passage region bottom surfaces.

2. The bridge body of claim 1, wherein the upper recessed contact surfaces comprise concave contact surfaces.

3. A bridge body for a bridge assembly for a stringed instrument, the bridge body comprising:

a plurality of saddle regions arranged in the bridge body, each of the saddle regions configured to accommodate a saddle;

two receiving passages that pass through the bridge body from an upper side of the bridge body to a lower side of the bridge body;

upper recessed contact surfaces respectively arranged at upper ends of the receiving passages; and lower recessed contact surfaces respectively arranged at lower ends of the receiving passages.

4. The bridge body of claim 3, wherein the lower recessed contact surfaces comprise concave contact surfaces.

5. The bridge body of claim 1, further comprising a plurality of saddles, each of the plurality of saddles arranged in a respective saddle region.

6. The bridge body of claim 5, wherein the each of plurality of saddles includes a respective string groove and each of the respective string grooves has a different size.

7. The bridge body of claim 1, wherein the bridge body comprises a top surface, and wherein the top surface is planar.

8. The bridge body of claim 7, wherein the upper recessed contact surfaces are recessed relative to the top surface.

9. The bridge body of claim 1, wherein the two receiving passage region bottom surfaces are planar.

10. The bridge body of claim 9, further comprising lower recessed contact surfaces respectively arranged at lower ends of the receiving passages, wherein the lower recessed contact surfaces are recessed relative to the two receiving passage region bottom surfaces.

11. The bridge body of claim 1, wherein the central region bottom surface comprises an arcuate shape.

12. The bridge body of claim 1, further comprising side surfaces connecting between the central region bottom surface and each of the two receiving passage region bottom surfaces.

13. The bridge body of claim 12, wherein the side surfaces are planar.

14. The bridge body of claim 12, wherein the side surfaces comprise arcuate-shaped side surfaces.

15. The bridge body of claim 1, wherein the bridge body is a Nashville style bridge body.

16. The bridge body of claim 1, wherein the bridge body is an ABR-1 style bridge body.

17. The bridge body of claim 1, wherein the receiving passages are cylindrical.

18. The bridge body of claim 3, wherein the receiving passages are tapered and have a smaller upper opening to the upper recessed contact surfaces and a larger bottom opening to the lower recessed contact surfaces.

19. The bridge body of claim 1, wherein the upper recessed contact surfaces comprise tapered contact surfaces.

20. A fixed bridge body for a fixed bridge assembly for a stringed instrument, the fixed bridge body comprising:

a plurality of saddle regions arranged in the fixed bridge body, each of the saddle regions configured to accommodate a saddle;

two receiving passages having sidewalls, wherein the two receiving passages pass through the fixed bridge body from an upper side of the fixed bridge body to a lower side of the fixed bridge body; and upper recessed contact surfaces respectively arranged at upper ends of the sidewalls of the receiving passages, wherein the recessed contact surfaces are different from the sidewalls.

21. A bridge body for a bridge assembly for a stringed instrument, the bridge body comprising:

a plurality of saddle regions arranged in the bridge body, each of the saddle regions configured to accommodate a saddle;

two receiving passages having sidewalls, wherein the two receiving passages pass through the bridge body from an upper side of the bridge body to a lower side of the bridge body; and upper recessed contact surfaces respectively arranged at upper ends of the sidewalls of the receiving passages, wherein the recessed contact surfaces are different from the sidewalls, wherein the bridge body comprises a top surface, and wherein the upper recessed contact surfaces are recessed relative to the top surface.

22. A bridge body for a bridge assembly for a stringed instrument, the bridge body comprising:

a plurality of saddle regions arranged in the bridge body, each of the saddle regions configured to accommodate a saddle;

two receiving passages having sidewalls, wherein the two receiving passages pass through the bridge body from an upper side of the bridge body to a lower side of the bridge body; and upper recessed contact surfaces respectively arranged at upper ends of the sidewalls of the receiving passages, wherein the recessed contact surfaces are different from the sidewalls, and wherein the bridge body is monolithic.

* * * * *